US008419016B2

(12) United States Patent
Yoseloff et al.

(10) Patent No.: US 8,419,016 B2
(45) Date of Patent: Apr. 16, 2013

(54) PLAYING CARD DELIVERY FOR GAMES WITH MULTIPLE DEALING ROUNDS

(75) Inventors: Mark L. Yoseloff, Henderson, NV (US); Roger M. Snow, Henderson, NV (US); Attila Grauzer, Las Vegas, NV (US)

(73) Assignee: SHFL Entertainment, Inc., Las Vegas, NV (US)

( * ) Notice: Subject to any disclaimer, the term of this patent is extended or adjusted under 35 U.S.C. 154(b) by 1424 days.

(21) Appl. No.: 11/436,828

(22) Filed: May 17, 2006

(65) Prior Publication Data

US 2007/0267811 A1 Nov. 22, 2007

(51) Int. Cl.
*A63F 1/12* (2006.01)

(52) U.S. Cl.
USPC ..... 273/149 R

(58) Field of Classification Search ..... None
See application file for complete search history.

(56) References Cited

U.S. PATENT DOCUMENTS

| | | | | |
|---|---|---|---|---|
| 793,489 | A | 6/1905 | Williams | |
| 1,014,219 | A | 1/1912 | Hall | |
| 2,001,220 | A | 5/1935 | Smith | |
| 2,001,918 | A | 5/1935 | Nevius | |
| 2,016,030 | A | 10/1935 | Woodruff et al. | |
| 2,043,343 | A | 6/1936 | Warner | |
| 2,065,824 | A | 12/1936 | Plass | |
| 2,254,484 | A | 9/1941 | Hutchins | |
| 2,328,153 | A | 8/1943 | Laing | |
| 2,328,879 | A | 9/1943 | Isaacson | |
| 2,364,413 | A | 12/1944 | Wittel | |
| 2,778,644 | A | 1/1957 | Stephenson | |
| 2,937,739 | A | 5/1960 | Levy | |
| 2,950,005 | A | 8/1960 | MacDonald | |
| 3,147,978 | A | 9/1964 | Sjöstrand | |
| 3,235,741 | A | 2/1966 | Plaisance | |
| 3,312,473 | A | 4/1967 | Friedman et al. | |
| 3,690,670 | A | 9/1972 | Cassady et al. | |
| 3,716,238 | A | 2/1973 | Porter | |
| 3,897,954 | A * | 8/1975 | Erickson et al. | 273/149 R |

(Continued)

FOREIGN PATENT DOCUMENTS

| | | |
|---|---|---|
| WO | WO 87/00764 | 2/1987 |
| WO | WO 98/40136 | 9/1998 |
| WO | WO 00/51076 | 8/2000 |

OTHER PUBLICATIONS

Service Manual/User Manual for Single Deck Shufflers: BG1, BG2 and BG3 by Shuffle Master © 1996.

(Continued)

*Primary Examiner* — Alvin A Hunter
*Assistant Examiner* — Dolores Collins
(74) *Attorney, Agent, or Firm* — TraskBritt

(57) ABSTRACT

An electromechanical card-handling apparatus and method creates or generates a plurality of sets of cards from a group of unshuffled cards wherein each set contains a predetermined number of randomly selected or arranged cards. Sets of cards are provided in a step-wise fashion, with first initial cards provided and then subsequent cards provided in a single step or in multiple steps in a preprogrammed mariner. The apparatus is controlled by a programmable microprocessor and may be monitored by a plurality of sensors and limit switches. The apparatus can be programmed for the number of players, the number of cards to be provided in each segment of play, and the dealing intervals among the various segments of card delivery and play.

26 Claims, 21 Drawing Sheets

U.S. PATENT DOCUMENTS 3,944,230 A 3/1976 Fineman
4,159,581 A 7/1979 Lichtenberg
4,232,861 A 11/1980 Maul
4,361,393 A 11/1982 Noto
4,368,972 A 1/1983 Naramore
4,385,827 A 5/1983 Naramore
4,397,469 A 8/1983 Carter, III
4,497,488 A 2/1985 Plevyak et al.
4,513,969 A * 4/1985 Samsel, Jr. ..... 273/149 R
4,515,367 A 5/1985 Howard
4,534,562 A 8/1985 Cuff et al.
4,566,782 A 1/1986 Britt et al.
4,586,712 A 5/1986 Lorber et al.
4,659,082 A * 4/1987 Greenberg ..... 273/149 R
4,662,637 A 5/1987 Pfeiffer
4,667,959 A 5/1987 Pfeiffer et al.
4,741,524 A 5/1988 Bromage
4,750,743 A 6/1988 Nicoletti
4,770,421 A 9/1988 Hoffman
4,807,884 A * 2/1989 Breeding ..... 273/149 R
4,822,050 A 4/1989 Normand et al.
4,832,342 A 5/1989 Plevyak et al.
4,900,009 A 2/1990 Kitahara et al.
4,951,950 A 8/1990 Normand et al.
4,969,648 A 11/1990 Hollinger et al.
5,000,453 A 3/1991 Stevens et al.
5,067,713 A 11/1991 Soules et al.
5,121,192 A 6/1992 Kazui
5,121,921 A * 6/1992 Friedman et al. ..... 273/149 P
5,199,710 A 4/1993 Lamle
5,240,140 A 8/1993 Huen
5,261,667 A 11/1993 Breeding
5,275,411 A * 1/1994 Breeding ..... 273/149 R
5,288,081 A 2/1994 Breeding
5,303,921 A 4/1994 Breeding
5,356,145 A 10/1994 Verschoor
5,374,061 A * 12/1994 Albrecht ..... 273/149 R
5,382,024 A 1/1995 Blaha
5,382,025 A 1/1995 Sklansky et al.
5,390,910 A 2/1995 Mandel et al.
5,431,399 A * 7/1995 Kelley ..... 273/149 P
5,437,462 A 8/1995 Breeding
5,584,483 A 12/1996 Sines et al.
5,586,936 A 12/1996 Bennett et al.
5,605,334 A 2/1997 McCrea, Jr.
5,669,816 A 9/1997 Garczynski et al.
5,676,372 A 10/1997 Sines et al.
5,681,039 A 10/1997 Miller
5,683,085 A 11/1997 Johnson et al.
5,690,324 A 11/1997 Otomo et al.
5,692,748 A 12/1997 Frisco et al.
5,695,189 A 12/1997 Breeding et al.
5,707,287 A 1/1998 McCrea, Jr.
5,718,427 A 2/1998 Cranford et al.
5,722,893 A 3/1998 Hill et al.
5,772,505 A 6/1998 Garczynski et al.
5,779,546 A 7/1998 Meissner et al.
5,803,808 A 9/1998 Strisower
5,941,769 A 8/1999 Order
5,944,310 A 8/1999 Johnson et al.
D414,527 S 9/1999 Tedham
5,989,122 A * 11/1999 Roblejo ..... 463/22
6,019,368 A 2/2000 Sines et al.
6,039,650 A 3/2000 Hill
6,068,258 A 5/2000 Breeding et al.
6,093,103 A 7/2000 McCrea, Jr.
6,117,012 A 9/2000 McCrea, Jr.
6,126,166 A 10/2000 Lorson et al.
6,127,447 A 10/2000 Mitry et al.
6,139,014 A 10/2000 Breeding et al.
6,149,154 A * 11/2000 Grauzer et al. ..... 273/149 R
6,165,069 A 12/2000 Sines et al.
6,165,072 A 12/2000 Davis et al.
6,217,447 B1 4/2001 Lofink et al.
6,250,632 B1 6/2001 Albrecht
6,254,096 B1 7/2001 Grauzer et al.
6,254,484 B1 7/2001 McCrea, Jr.
6,267,248 B1 7/2001 Johnson et al.
6,270,404 B2 8/2001 Sines et al.
6,299,167 B1 10/2001 Sines et al.
6,299,536 B1 10/2001 Hill
6,325,373 B1 12/2001 Breeding et al.
6,346,044 B1 2/2002 McCrea, Jr.
6,361,044 B1 3/2002 Block et al.
6,403,908 B2 6/2002 Stardust et al.
6,460,848 B1 10/2002 Soltys et al.
6,517,435 B2 2/2003 Soltys et al.
6,517,436 B2 2/2003 Soltys et al.
6,520,857 B2 2/2003 Soltys et al.
6,527,271 B2 3/2003 Soltys et al.
6,530,836 B2 3/2003 Soltys et al.
6,530,837 B2 3/2003 Soltys et al.
6,533,276 B2 3/2003 Soltys et al.
6,533,662 B2 3/2003 Soltys et al.
6,579,180 B2 6/2003 Soltys et al.
6,579,181 B2 6/2003 Soltys et al.
6,588,750 B1 * 7/2003 Grauzer et al. ..... 273/149 R
6,588,751 B1 7/2003 Grauzer et al.
6,612,927 B1 9/2003 Slomiany et al.
6,629,894 B1 10/2003 Purton
6,651,981 B2 11/2003 Grauzer et al.
6,651,982 B2 11/2003 Grauzer et al.
6,655,684 B2 * 12/2003 Grauzer et al. ..... 273/149 R
6,659,460 B2 12/2003 Blaha et al.
6,719,288 B2 * 4/2004 Hessing et al. ..... 273/149 R
6,726,205 B1 4/2004 Purton
6,732,067 B1 5/2004 Powderly
6,889,979 B2 5/2005 Blaha et al.
7,059,602 B2 * 6/2006 Grauzer et al. ..... 273/149 R
7,073,791 B2 * 7/2006 Grauzer et al. ..... 273/149 R
7,137,627 B2 * 11/2006 Grauzer et al. ..... 273/149 R
7,234,698 B2 * 6/2007 Grauzer et al. ..... 273/149 R
7,255,344 B2 * 8/2007 Grauzer et al. ..... 273/149 R
7,261,294 B2 * 8/2007 Grauzer et al. ..... 273/149 R
7,278,923 B2 * 10/2007 Grauzer et al. ..... 463/47
7,322,576 B2 * 1/2008 Grauzer et al. ..... 273/149 R
7,338,044 B2 * 3/2008 Grauzer et al. ..... 273/149 R
7,413,191 B2 * 8/2008 Grauzer et al. ..... 273/149 R
2003/0052450 A1 3/2003 Grauzer et al.
2003/0090059 A1 5/2003 Grauzer et al.
2003/0094756 A1 5/2003 Grauzer et al.
2004/0245720 A1 12/2004 Grauzer et al.
2005/0051956 A1 3/2005 Grauzer et al.
2005/0104289 A1 5/2005 Grauzer et al.
2005/0146093 A1 7/2005 Grauzer et al.
2005/0206077 A1 9/2005 Grauzer et al.
2006/0033269 A1 2/2006 Grauzer et al.
2006/0181022 A1 8/2006 Grauzer et al.

OTHER PUBLICATIONS

CD Labeled "Shuffler Art". Attached to this 1449 is a spreadsheet having the names of the individual files within the CD. There is a self-executing function on the CD so that, upon entering the Spreadsheet Table of Contents (Index), individual items may be opened directly from the spreadsheet according to the title of the document.

DVD Labeled "Luciano Decl. Ex. K". This is the video taped live Declaration of Mr. Luciano taken during preparation of litigation.

DVD Labeled "Solberg Decl. Ex. C". This is the video taped live Declaration of Mr. Solberg, a witness for the defense, taken during preparation for litigation.

DVD labeled Morrill Decl. Ex. A:. This is the video taped live Declaration of Mr. Robert Morrill, a lead trial counsel for the defense, taken during preparation for litigation. He is describing the operation of the Roblejo Prototype device.

DVD labeled Exhibit 1. This is a DVD taken by Shuffle Master personnel of the live operation of a CARD One2Six™ Shuffler.

Scarne's Encyclopedia of Games by John Scarne, 1973, "Super Contract Bridge", p. 153.

Specification of Australian Patent Application No. 31577/95, filed Jan. 17, 1995, Applicants: Rodney G. Johnson et al., Title: Card Handling Apparatus.

Specification of Australian Patent Application No. Not Listed, filed Aug. 15, 1994, Applicants: Rodney G. Johnson et al., Title: Card Handling Apparatus.
PCT International Search Report for corresponding PCT Application No. PCT/US2007/011745, mailed Sep. 23, 2008.
Written Opinion for corresponding PCT Application No. PCT/US2007/011745, mailed Sep. 23, 2008.

* cited by examiner

PLAYING CARD DELIVERY FOR GAMES WITH MULTIPLE DEALING ROUNDS

TECHNICAL FIELD

The present invention relates to devices for handling cards, including cards known as "playing cards." In particular, it relates to an electromechanical machine for delivering, randomizing, shuffling, organizing or arranging playing cards so that the playing cards may be provided as a plurality of hands, wherein each hand is formed by a selected number of randomly arranged cards.

BACKGROUND

Wagering games based on the outcome of randomly generated or selected symbols are well known. Such games are widely played in gambling establishments, such as casinos, and include card games wherein the symbols comprise familiar, common playing cards. Card games such as "twenty-one" or "blackjack," poker and the like are excellent card games for use in casinos. Desirable attributes of casino card games are that they are exciting, that they can be learned and understood easily by players, and that they move or are played rapidly to their wager-resolving outcome.

From the perspective of players, the time the dealer must spend shuffling cards diminishes the excitement of the game. From the perspective of casinos, shuffling time reduces the number of wagers placed and resolved in a given amount of time, thereby reducing revenue. Casinos would like to increase the amount of revenue generated by a game without changing games, particularly a popular game, and without increasing the minimum size of wagers. One approach to speeding play is to speed shuffling. This approach has lead to the development of electromechanical or mechanical card-shuffling devices. Such devices increase the speed of shuffling and dealing, thereby increasing playing time. Such devices also add to the excitement of a game by reducing the time the dealer or house has to spend in preparing to play the game.

U.S. Pat. Nos. 4,513,969 (Samsel, Jr.) and 4,515,367 (Howard) disclose automatic card shufflers. The Samsel, Jr. patent discloses a card shuffler having housing with two wells for receiving stacks of cards. A first extractor selects, removes and intermixes the bottommost card from each stack and delivers the intermixed cards to a storage compartment. A second extractor sequentially removes the bottommost card from the storage compartment and delivers it to a typical shoe from which the dealer may take the card for presentation to the players.

The Howard patent discloses a card mixer for randomly interleaving cards including a carriage supported ejector for ejecting a group of cards (approximately two playing decks in number) which may then be removed manually from the shuffler or dropped automatically into a chute for delivery to a typical dealing shoe.

U.S. Pat. No. 4,586,712 (Lorber et al.) discloses an automatic shuffling apparatus designed to intermix multiple decks of cards under the programmed control of a computer. The Lorber et al. apparatus is a carousel-type shuffler having a container, a storage device for storing shuffled playing cards, a removing device and an inserting device for intermixing the playing cards in the container, a dealing shoe and supplying means for supplying the shuffled playing cards from the storage device to the dealing shoe.

U.S. Pat. No. 5,000,453 (Stevens et al.) discloses an apparatus for automatically shuffling cards. The Stevens et al. machine includes three contiguous magazines with an elevatable platform in the center magazine only. Unshuffled cards are placed in the center magazine and the spitting rollers at the top of the magazine spit the cards randomly to the left and right magazines in a simultaneous cutting and shuffling step. The cards are moved back into the center magazine by direct lateral movement of each shuffled stack, placing one stack on top of the other to stack all cards in a shuffled stack in the center magazine.

U.S. Pat. No. 3,897,954 (Erickson et al.) discloses the concept of delivering cards one at a time, into one of a number vertically stacked card-shuffling compartments. The Erickson patent also discloses using a logic circuit to determine the sequence for determining the delivery location of a card, and that a card shuffler can be used to deal stacks of shuffled cards to a player. U.S. Pat. No. 5,240,140 (Huen) discloses a card dispenser which dispenses or deals cards in four discrete directions onto a playing surface, and U.S. Pat. Nos. 793,489 (Williams), 2,001,918 (Nevius), 2,043,343 (Warner) and 3,312,473 (Friedman et al.) disclose various card holders some of which include recesses (e.g., Friedman et al.) to facilitate removal of cards. U.S. Pat. Nos. 2,950,005 (MacDonald) and 3,690,670 (Cassady et al.) disclose card-sorting devices which require specially marked cards.

U.S. Pat. No. 4,770,421 (Hoffman) discloses a card-shuffling device including a card-loading station with a conveyor belt. The belt moves the lowermost card in a stack onto a distribution elevator whereby a stack of cards is accumulated on the distribution elevator. Adjacent to the elevator is a vertical stack of mixing pockets. A microprocessor preprogrammed with a finite number of distribution schedules sends a sequence of signals to the elevator corresponding to heights called out in the schedule. Each distribution schedule comprises a preselected distribution sequence, which is fixed as opposed to random. Single cards are moved into the respective pocket at that height. The distribution schedule is either randomly selected or schedules are executed in sequence. When the microprocessor completes the execution of a single distribution cycle, the cards are removed a stack at a time and loaded into a second elevator. The second elevator delivers cards to an output reservoir.

Another card-handling apparatus with an elevator is disclosed in U.S. Pat. No. 5,683,085 (Johnson et al.). U.S. Pat. No. 4,750,743 (Nicoletti) discloses a playing card dispenser including an inclined surface and a card pusher for urging cards down the inclined surface.

Other known card-shuffling devices are disclosed in U.S. Pat. Nos. 2,778,644 (Stephenson), 4,497,488 (Plevyak et al.), 4,807,884 and 5,275,411 (both Breeding) and 5,695,189 (Breeding et al.). The Breeding patents disclose machines for automatically shuffling a single deck of cards including a deck receiving zone, a carriage section for separating a deck into two deck portions, a sloped mechanism positioned between adjacent corners of the deck portions, and an apparatus for snapping the cards over the sloped mechanism to interleave the cards.

The Breeding single deck shufflers used in connection with LET IT RIDE® stud poker are programmed to first shuffle a deck of cards, and then sequentially deliver hands of a preselected number for each player. LET IT RIDE® stud poker is the subject of U.S. Pat. Nos. 5,288,081 and 5,437,462 (Breeding), which are herein incorporated by reference. The Breeding single deck shuffler delivers three cards from the shuffled deck in sequence to a receiving rack. The dealer removes the first hand from the rack. Then, the next hand is automatically delivered. Breeding et al., U.S. Pat. No. 5,695,189 is directed to a shuffling machine for shuffling multiple decks of cards with three magazines wherein unshuffled cards are cut and then shuffled.

U.S. Pat. No. 5,431,399 (Kelley) describes a hand-forming system that tends to be specific for use in contract bridge or duplicate bridge. In one form of the invention chosen for purposes of illustration in the drawings, FIG. 1 of Kelley shows an exterior perspective. Side walls 2 and 3 form an enclosure that is deep enough to hold a deck of playing cards. The length of side 3 is approximately the width of a card; the length of side 2 is approximately the length of a card, which thus establishes how the cards are oriented in the device. Side 2 has a cutaway opening so as to allow removal of the cards placed in the enclosure if necessary. The enclosure has a removable weighted top 1 that when placed on top of a deck of cards provides a downward pressure on the deck of cards. Element 5 is a slot in the base of the enclosure through which a contact means can engage the bottom card of the deck to cause its horizontal displacement. The device is shown with a holding compartment with sides 11 and base 10 for temporary storage of a card deck or program cards. Underneath this compartment are five holding receptacles with notched base 13 and end 12 to hold the cards after they pass through the device. Several switches 7 are accessible and can be used to initiate card dealing and to enter information into the system as to contract and result. There is also a small visual display 6 that can be used for indicating facts about the hand (dealer, vulnerability, board number) as well as for validating information that the user may enter with the switches 7.

U.S. Pat. No. 5,240,140 (Huen) describes a shuffling device for playing cards. Among the features described in Huen is a card dispenser 10 that includes microprocessor-based electronic circuitry 28 which controls the operation of the actuators 22 in a random order. In other words, even if the cards 14 are stacked in a particular order and are to be dispensed one by one downwards in that order, the directions in which or the locations (four sides of the body 11) to which they are to be dispensed will be in an unpredictable manner. Despite the random order in which the actuators 22 are operated, the electronic circuitry 28 will ensure (by means of counters) that the cards 14 are distributed at the end in a particular manner according to the card game to be played, such as four suits of thirteen cards for a bridge game. In the case of playing games such as poker, the card dispenser 10 can be controlled to dispense a single card at a time. The distribution mode is presettable by a user through a control panel 29 on the body 11. The control panel 29 has a liquid crystal display 30 and six buttons 31, and also enables a user to switch on/off and to start or interrupt the operation of the card dispenser 10, to input the number of locations (players), and to disable the shuffling function.

U.S. Pat. Nos. 4,951,950 and 4,822,050 (Normand et al.) describe a shuffling device with user input features thereon. FIGS. 1 and 2 of Normand et al. show the distributing device in the form of a rectangular box with a housing 2 in the form of a shoe sized according to a deck of cards and closed by a hinged cover 3. Alongside shoe 2, box 1 comprises display 4 for associating, with each of the four cardinal points symbolizing the players, an indicator lamp 5 comprising a diode. At the center display 4 includes a liquid crystal device 6 displaying a deal number. On the side as an extension to shoe 2, box 1 has slot 7 for the successive exit of the playing cards 8. Near display 4, box 1 includes key set 9 which, as will be explained further, controls certain functions such as: presentation of first card after insertion of the deck of cards to be dealt into the shoe, scrolling forward and backward of the deal numbers, callback of the display of the last card withdrawn etc. In addition, connector 10 makes it possible to connect the dealing device to a serial or parallel source of information and if necessary to a power outlet for direct supply or for battery recharging purposes. It is further stated that there is "a key set 46 controlling the display of a variety of operations such as initialization, stop function, battery recharge, etc."

U.S. Pat. No. 4,662,637 (Pfeiffer) discloses a device for use with a card game format. The device of Pfeiffer includes a plurality of user stations 28 distributed around the apparatus. Each user station 28 has an output port where cards are delivered face down. Dealt cards are removed from each output port through a slit 34 under hinged output door 20. A finger notch 32 formed in base 14 and door 20 at each user station 28 permits player access to dealt cards in the output port without having to lift door 20. The apparatus has selector recesses 42 adapted for receiving selectors 74 indicating a user's card selection. Recesses 42 are typically positioned at each player position 28 in a molded base 14 beneath the corresponding output port. Selector dials, slides or buttons on the selector may be provided to make the card selection. Once inserted, the selector makes contact through a connector to register the desired selection. Alternatively, selectors may communicate card selections to the apparatus 10 via wired connection or infrared beams.

U.S. Pat. No. 6,655,684 (Grauzer et al.) describes a shuffling device with dealer input features. Another feature of that invention is providing a programmable card-handling machine with a display and appropriate inputs for adjusting the machine to any of a number of games wherein the inputs include one or more of a number of cards per hand or the name of the game selector, a number of hands delivered selector and a trouble-shooting input. Residual cards after all designated hands are dealt may be stored within the machine, delivered to an output tray that is part of the machine, or delivered for collection out of the machine, usually after all hands have been dealt and/or delivered.

Published U.S. Application 2005/0145093 (Grauzer et al.) describes a shuffler with game selection unit. It specifically describes an automatic card shuffler comprising: a card infeed area, the area accepting a group of cards to be randomized; a card feeder capable of moving cards from the card infeed area to a shuffling mechanism; a card-shuffling mechanism, whereby an order of fed cards is randomized, and at least one random hand of cards is formed; a card-removing device, the device moving the at least one random hand of cards into a delivery tray, a delivery tray; a microprocessor programmable to control operation of the shuffler; and a user input device for selecting game information. The game information is selected from the group consisting of game names, and numbers of cards per hand. A display is in communication with the microprocessor for displaying game information.

Published U.S. Application 2005/0051956 (Grauzer et al.) (now U.S. Pat. No. 7,073,791) describes a shuffling device that includes a description of another feature of the providing a programmable card-handling machine with a display and appropriate inputs for adjusting the machine to any of a number of games wherein the inputs include one or more of a number of cards per hand or the name-of-the-game selector, a number-of-hands-delivered selector and a trouble-shooting input. Residual cards after all designated hands are dealt may be stored within the machine, delivered to an output tray that is part of the machine, or delivered for collection out of the machine, usually after all hands have been dealt and/or delivered. Additionally, there may be an elevator speed or carousel drive speed adjustment and position sensor to accommodate or monitor the position of the elevator or carousel as cards wear or become bowed or warped. These features also provide for interchangeability of the apparatus, meaning the same apparatus can be used for many different games and in different locations, thereby reducing the number of back-up machines or units required at a casino.

Published U.S. Application 2005/0104289 (Grauzer et al.) (now U.S. Pat. No. 7,059,602) discloses the formation of subgroups of cards (more than one card) within compartments in a shuffling device, and the delivery of the subgroups, one at a time or multiple groups at a time, to a delivery area where the cards are manually provided to the players and (where needed) to the dealer.

The casino environment has dramatically changed in the past fifteen years, when the prevailing card games were blackjack and baccarat. There were almost no games besides these two card games where additional cards were provided to the players, and no card games where sequences of varying numbers of cards might have to be automatically dealt at various stages of the game. The introduction of such games, such as draw poker, Texas Hold'Em, Omaha Poker, CRAZY 4 POKER®, FOUR CARD POKER™, SIX CARD POKER™, 3-5-7POKER™, and other games introduced greater complexity to the delivery of cards to players, to dealers and to community card areas. This complexity also introduced the potential for errors and fraud by the misdealing numbers of cards, the positions to which cards were dealt, and when cards were to be dealt and delivered.

Prior systems such as the Shuffle Master ACE® shuffler or BG-3™ shuffler that provide individual hands to be delivered by the dealer, deliver a single fixed number of cards to the delivery tray at a single time (with the total number delivered one card at a time, portions of the cards pushed into the tray up to the specific fixed number of cards, or all cards of the total number pushed into the tray from a compartment). In games such as LET IT RIDE® poker, where each player gets three cards and the community cards comprise two cards, the shuffler deals out a steady stream of three-card sets, and the dealer removes one card from the last three-card set to for the two-card community set. In FOUR CARD POKER™, the players are dealt five cards and the dealer is dealt six cards. This is done by feeding out a steady stream of five-card sets, and the dealer takes an additional one card from the last five-card set to provide the sixth card needed for the dealer's six-card hand.

As can be seen, the provision of additional cards or removal of cards, usually to and from the dealer's cards, offers the opportunity for deviations between the number of cards dispensed and the number of cards used (e.g., removing the top, bottom or middle card in LET IT RIDE® poker; or the selection of the $1^{st}$, $2^{nd}$, $3^{rd}$, $4^{th}$ or $5^{th}$ cards in FOUR CARD POKER™) and, therefore, presents an appearance of an opportunity for manipulation of the ultimate results by altering the position from which cards are selected for removal or delivery. This can lead to misperception by players that the house can control or manipulate game outcomes.

Although the devices disclosed in the preceding patents and published applications provide improvements in card-shuffling devices, none discloses or suggests a device and method for providing a plurality of hands of cards, wherein additional numbers of cards or partial hands of a selected number of randomly arranged cards and specific numbers of varied or variable cards for later placement and/or distribution are formed, facilitating the casino play of new card games.

SUMMARY OF THE INVENTION

The present invention provides an electromechanical card-handling apparatus and method for creating or generating a plurality of hands of cards from a group of unshuffled cards wherein each hand contains a predetermined number of randomly selected or arranged cards and cards are provided in a step-wise fashion, with first initial partial hands of cards being provided and then subsequent cards provided in a single step or in multiple steps in a preprogrammed manner to complete the distribution of cards to players. The apparatus and, thus, the card-handling method or process, is controlled by a programmable microprocessor and may be monitored by a plurality of sensors and limit switches. The apparatus can be programmed for the number of players, the number of cards to be provided in each dealing segment, and the number of dealing intervals during play.

While the card-handling apparatus and method of the present invention is well suited for use in the gaming environment, particularly in casinos, the apparatus and method may find use in homes, card clubs, or for handling or sorting sheet material generally. The delivery of the segments of cards can be from a programmed delivery shoe with automated card movement or preferably from a card shuffler with card delivery functionality.

DETAILED DESCRIPTION OF THE INVENTION

Figure 1:
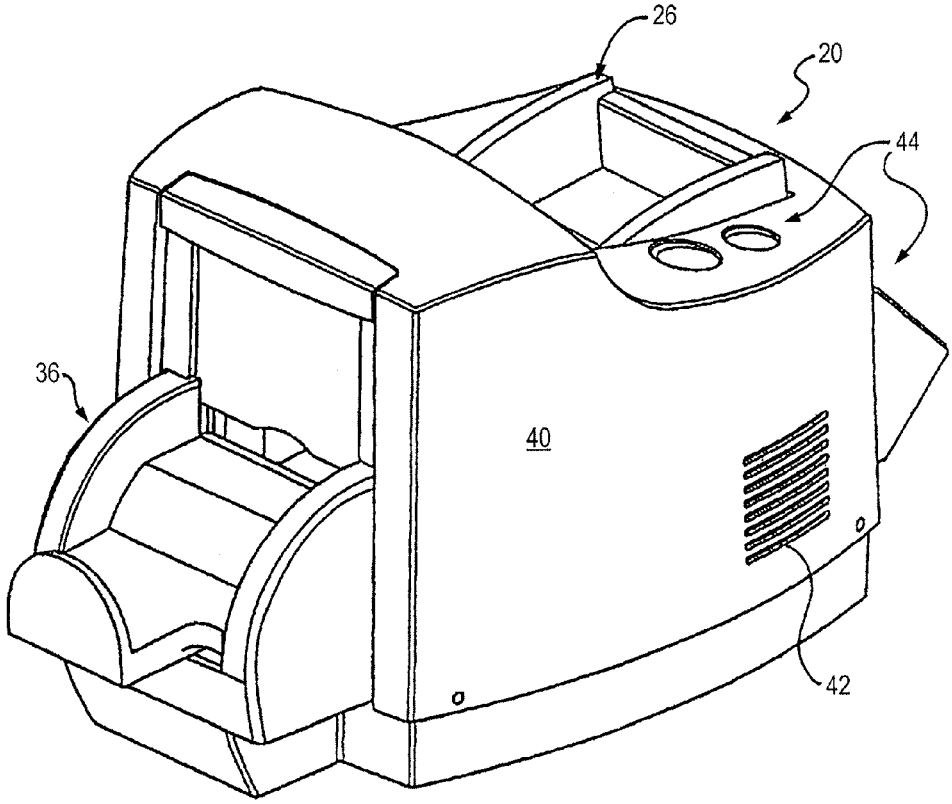
FIG. 1 is a front perspective view depicting the apparatus of the present invention.

In one embodiment, the present technology provides an apparatus for moving playing cards from a first group of unshuffled cards (e.g., a deck or decks) into shuffled groups of cards (partial hands, subsets of partial hands, intermediate segments of hands, extra cards, bonus hands, partial bonus hands, partial groups of community cards and community cards, etc.), wherein at least one of said groups contains a random arrangement or selection of a preselected number of cards. The apparatus comprises a card receiver for receiving the first group of cards, a randomizing or shuffling section (generally a vertical stack of horizontally disposed card-receiving compartments or a carousel, wheel or fan of compartments generally adjacent to the card receiver, the stack, wheel, carousel or fan having generally (vertically or rotationally) movable compartments), an elevator or motor for relatively raising and lowering the compartments (in the stack, wheel, carousel or fan), a card-moving mechanism between the card receiver and the stack, carousel, wheel or fan for moving cards, one at a time, from the card receiver to a selected compartment, and a microprocessor that controls the card-moving mechanism and the elevator or motor so that each card in the group of unshuffled cards is placed randomly into one of the compartments. Sensors monitor and trigger operation of the apparatus, including the microprocessor, card-moving mechanisms, and the elevator or motor (to rotate the wheel, carousel or fan). The controlling microprocessor, including software, randomly selects or identifies which slot or compartment will receive each card in the group before card-handling operations begin. For example, a card designated as card 1 may be directed to slot 5, a card designated as card 2 may be directed to slot 7, a card designated as card 3 may be directed to slot 3, etc.

An advantage of the present invention is that it provides a programmable card-handling machine (delivery shoe, smart delivery shoe, shuffler, smart shuffler, etc.) with a display and appropriate inputs for adjusting the machine to provide groups of cards to any of a number of games wherein the inputs include at least some of a) a number of cards per hand selector, b) a number of hands delivered selector, c) a trouble-shooting input, d) in combination with card segment input (e.g., how many different segments or steps or intervals of card dealing will occur within a game), e) how many cards are to be provided to each player in each segment, and f) how many cards are to be provided to distinct positions (player hands, dealer hand, bonus hand, alternative hands and community cards) for each segment. Additionally, there may be an elevator, gearing, belt gearing or motor (for rotation) speed adjustment and sensor(s) to accommodate or monitor the position of the elevator, wheel, carousel or fan as cards wear or become bowed or warped. These features also provide for interchangeability of the apparatus, meaning the same apparatus can be used for many different games and in different locations thereby reducing the number of backup machines or units required at a casino. The display may include a game mode or game selected display, and use a cycle rate and/or hand count monitor and display for determining or monitoring the usage of the machine.

Another advantage of the present invention is that it provides an electromechanical playing card-handling apparatus for more rapidly generating distinct sets and subsets of cards at the appropriate time and interval for certain types of card games. Devices of the present invention advantageously reduce manual distribution of cards. The preferred shuffling device completes a shuffling cycle in approximately 30 seconds, which is double the speed of the Breeding single deck shuffler disclosed in U.S. Pat. No. 4,807,884. Although some of the groups of playing cards (including player and dealer hands, community cards, first segment of play sets of cards, second segment of play sets of cards, third segment of play sets of cards, etc., and discarded or unused cards) arranged by the apparatus in accordance with the method of the present technology may contain the same number of cards or different numbers of cards, the cards of any one group or hand are randomly selected and placed therein. Other advantages include a reduction of set up time, reduction of dealing time, increased automation of card delivery, better player perception of fairness, increased reliability, lower maintenance and repair costs, and a reduction or elimination of problems such as card counting, possible dealer manipulation and card tracking, thereby increasing the integrity of a game and enhancing casino security.

Yet another advantage of the card-handling apparatus of the present invention is that it converts a single deck of unshuffled cards into a plurality of hands (player hands, dealer hand, bonus hand, alternative hands and community cards; as well as the segments of each of the hands or sets of cards provided) ready for use in playing a game. The sets and hands are substantially completely random, i.e., the cards comprising each hand, set, subset or segment are randomly placed into that hand, set, subset or segment. To accomplish this, the preferred embodiment of the apparatus includes a number of vertically stacked, horizontally disposed card-receiving compartments. The compartments may be arranged, one above another, circumferentially adjacent and radially opened. Cards are inserted, one at a time, until an entire group of cards is distributed. In a preferred embodiment, each compartment receiving cards is filled (or at least contains at least one card), regardless of the number of players participating in a particular game. For example, for a seven player game, seven player compartments, a dealer compartment and one compartment for cards not used in forming the random hands may be filled. After the last card from the unshuffled group is delivered, the hands, sets, subsets, segments or partial hands are ready to be removed from the compartments and put into play.

In one embodiment, a separate compartment is provided for each set or partial hand of cards dealt out of the same deck of cards. For example, a game may require that a five-card poker game be dealt in sets of three cards, followed by a round of betting, then sets of two cards, to form five-card hands. A compartment for each set is provided so that all of the cards in the deck are randomly distributed before the first set of cards is dispensed. This procedure assures the most random distribution.

The preferred device of the present technology may include jammed card detection, detection of insufficient or excess numbers of cards (in a chamber, in the delivery tray, within a compartment or throughput in the system, etc.) and recovery features, and may include jam recovery procedures and/or stop play procedures operated and controlled by the microprocessor.

Generally, the operation of the card-handling apparatus of the present invention will form a fixed number of hands, sets, partial hands, subsets, segments, and the like, of cards corresponding to the maximum number of players at a table, plus a dealer hand (where used), community cards, partial or entire spare hands, partial or entire bonus hands, and possibly one or more discard piles. The device may be programmed to deliver the sets in multiple stages or steps during a round of play. In other examples of the invention, the dealer inputs the number of hands or hand segments needed for play, and the number of cards per hand segment. The remaining cards are deposited into one or more discard racks. For a typical casino table game having seven player stations, the device of the present invention would preferably have at least seventeen compartments, wherein sixteen of the seventeen compartments contain a partial hand of cards. The same number of cards in seven compartments is equal, and another seven compartments contain an equal number of cards, each used for a different interval of play. One additional compartment collects discards. Most preferably, the device is programmed to deliver hands, partial hands, sets, subsets, segment sets, subset or segments for a preprogrammed number of positions and less preferably until the dealer presses an input button.

The programmed or less preferable dealer input tells the microprocessor that the last hand, set, partial hand, subset, segment or the like has been delivered for that interval of play in the game, and then the second set of remaining cards may be delivered for the next interval of play. The delivered second set of cards will be unloaded into the output tray or delivery tray, one set at a time. When a set is removed, the next set is automatically delivered. Only at the end of the programmed provision delivery of the last segment of cards will all remaining cards be provided to the delivery tray or to the discard component. The discards or unused card hands, if any (i.e., the cards placed in the discard compartment(s) or slot(s)) may contain more cards or fewer cards than other compartments and, thus, the discard compartment may be larger than the other compartments. In one embodiment, the discard compartment is located in the middle of the generally vertically arranged stack of compartments or anywhere in the distribution of the wheel or carousel compartments or at the ends of the fan distribution of compartments (a fan being less than the entire circumference of a wheel). In one form of the invention, a sufficient number of compartments are provided such that all card segments dealt from the same deck of cards and that are needed for the game are formed in a single random distribution process. In another form of the invention, cards are distributed to form initial sets, and then after delivery, additional cards are distributed to form additional sets.

Another advantage is that the shuffling format of the apparatus of the present invention provides for the initial top feeding or loading of an unshuffled group of cards thereby facilitating use by the dealer. The same is true of the hand receiving portion of the machine wherein a dealer is able to conveniently remove a randomized hand (sets, partial hands, subsets, and segments) from the upper portion of the machine. The same is true for the use of a system wherein a shuffled deck is provided to the card input area and the compartments are used in sequence or randomly to provide shuffled hands (sets, partial hands, subsets, segments) for delivery. The same type of feed program for delivery of hands (sets, partial hands, subsets, segments) may be used with a card-moving delivery shoe, as disclosed in U.S. Ser. No. 11/200,280, filed Aug. 9, 2005, now U.S. Pat. No. 7,717,427, issued May 18, 2010. Other related systems and shufflers provided for programming of the delivery of complete hands include, for example, U.S. patent application Ser. Nos. 11/057,712, filed Feb. 14, 2005, now U.S. Pat. No. 7,261,294, issued Aug. 28, 2007; Ser. No. 10/893,818, filed Jul. 19, 2004, abandoned; Ser. No. 11/059,104, filed Feb. 15, 2005, now U.S. Pat. No. 7,338,044, issued Mar. 4, 2008; and Ser. No. 11/039,155, filed Jan. 19, 2005, abandoned. These cases teach random card count dealing, and specific single round card count delivery, for example. All applications and references cited anywhere herein are incorporated in their entirety by this reference.

An additional advantage of the card-handling apparatus of the present invention is that it facilitates and significantly speeds the play of casino wagering games, particularly those games calling for a certain, fixed number of cards per hand (e.g., CARIBBEAN STUD™ poker, LET IT RIDE® poker, Pai Gow Poker, FORTUNE PAI GOW POKER®, Texas Hold'Em poker, Omaha poker, community card poker games in general, stud poker games and the like), making the games more exciting for players and more profitable for casinos. The device of the present invention is believed to deliver random hands or partial hands at approximately twice the speed of known devices.

In use, the apparatus of the present shuffler technology is operated to process playing cards from an initial, unshuffled or used group of cards into a plurality of hand segments. Multiple hand segments form a hand, and each hand typically contains the same number of randomly arranged cards. However, some games require the dealer to receive more or less cards than the players. The first step of this process is the dealer placing the initial group of cards into the card receiver of the apparatus. The "group" is typically a deck of cards but could be multiple decks. The apparatus is started and, under the control of the integral microprocessor, randomly assigns each card in the initial group to a compartment, based on the selected number of hands, and a selected number of cards per hand. The programming may also be used with so-called random ejection shufflers (as disclosed in U.S. Pat. Nos. 6,299,167; 6,019,368; 5,676,372; and 5,584,483) wherein a first unshuffled deck, decks or set of cards is put into an input area, and individual or multiple cards are ejected from the deck, decks or set of cards into an intermediate holding area or compartment, or directly into a delivery tray. The programming directs the delivery of cards, as described generally in greater detail, according to the requirements of hands, partial hands, sets, subsets or segments according to the intervals of the game. The delivery of each group of cards may be automatic or user actuated.

Each hand, partial hand, set, subset or segment is preferably contained in a separate compartment of the apparatus (although multiple compartments may be used, to form each set which may further assist in assuring randomness), and each hand, partial hand, set, subset or segment is delivered, upon the dealer's demand or automatically, by the apparatus from that compartment to a hand receiver, tray, shoe or platform for the dealer to distribute it to a player. The number of hands, partial hands, sets, subsets or segments created by the apparatus with each cycle are preferably selected, preselected and/or programmed to correspond to the maximum number of players allotted to participate in a game or the actual number of players at a table plus the dealer (when the games require the dealer to receive cards), and the number or quantity of cards per hand, partial hand, set, subset or segment is programmable according to the game being played.

The term "cycle" for purposes of this disclosure is the random delivery of all cards needed to complete a round of play at a table. The number of players participating in a round of play can vary. If the game is a single deck game, all cards from the deck are distributed into the compartments and are then ejected, defining a single shuffling cycle.

Each time a new group of unshuffled cards, used cards or a new deck of cards is loaded into the card receiver and the shuffling apparatus is activated, the operation of the apparatus involving that group of cards, i.e., the forming of that group of cards into partial or complete hands of random cards (either in a single step or multiple steps), comprises a new cycle. Each cycle is unique and is created by the microprocessor that is programmed to include random number generating capability. The software assigns a number to the each card and then randomly selects or correlates a compartment to each number. Under the control of the microprocessor, the elevator aligns the selected compartment with the card feed mechanism in order to receive the next card. The software then directs each numbered card to the selected slot by operating the elevator motor to position that slot to receive the card. In one form of the invention, a first group of partial hands is ejected prior to formation of a second (or more) groups of partial hands of cards. In a more preferred embodiment, all sets of cards used in a round of play are formed prior to ejection of the first set of cards.

The apparatus of the present invention is compact, easy to set up and program and, once programmed, can be maintained effectively and efficiently by minimally trained personnel that cannot affect the randomness of the card delivery. This means that the machines are more reliable in the field. Service costs are reduced, as are assembly and set-up costs. The preferred device also has fewer parts, which should provide greater reliability than known devices.

The programming, according to the novel technology described herein, that is used for the various systems, whether randomizers, shufflers or card delivery shoes (with automatic or mechanical card delivery), is enabling for the following effects in the following manner. Each of the specialty games that are used according to the novel technology described herein (the shufflers, randomizers and delivery shoes preferably retaining the functional and technical capability for previous standard functions) would include at least some of the following capabilities, in any order of operation so that the functions can be affected:

1. Identifying numbers of cards to be delivered to at least one player position in a first interval or segment of a game;
2. Identifying numbers of positions/players to which the cards of step 1) can be delivered, including a dealer position, where applicable;
3. Identifying the number of intervals and/or segments of play that are initially anticipated in the play of the game;
4. Accepting commands or input or instructions for the reduction of the number of player positions and subsequent numbers of hands, partial hands, sets or subsets of cards that are to be delivered (i.e., in the event players folded);
5. Accepting programming for the numbers of cards and variable numbers of cards that are to be provided in each interval of the game/games to be played;
6. A mechanical system capable of implementing the operation of the programming input to the system or commands to the system selection options among the available elements of the programming.

The programming and implementation of the programming may take place in many different ways. These implementations will be described and further enabled in the following descriptions.

Shuffler Implementation

In the use of shufflers with card-receiving compartments (e.g., stacks, wheels, carousels, and fans), randomized cards may be placed within the compartments in various ways according to the capability and volume constraints of the system. For example, with a fan system having multiple compartments, the programming might identify that in the first interval of play of a game (e.g., Texas Hold'Em will be used as a non-limiting example); two cards are to be provided for each player position. The dealer or an automated system (identifying the number of players by RFID, cameras, player card swipes, bet presence sensors, pit crew input, placement of wagers/antes, etc.) identifies the number of players.

In one embodiment with the fan system, the initial distribution of randomized cards into the compartments would randomly deliver two cards to at least the number of compartments necessary for delivery of two cards to each of the identified number of players. For example, if there were four players at the table, four compartments would be filled with two cards each. If there were three players, the same considerations would be made, where two cards would be provided to each of the three compartments. When there are seven players, the simplest operation would be for each of seven compartments to contain the two cards necessary for each of the seven players.

According to programming suitable for this particular game, the shuffler uses one or more compartments to provide at least one random three-card flop hand. It is possible for the shuffler to provide more than one three-card flop set of cards and then randomly eject one of the flop sets when delivery of the flop is required by the interval play of the game. Remaining three-card sets may be retained in the compartments of the shuffler or ejected as a separate step. When the shuffler is optimized for one game and then used for another game, some compartments may be empty, or may be used to perform other functions. For example, in the play of Texas Hold'Em, it is often a format of dealing to remove a top card from the deck before providing the flop, before providing fourth street, and/or before providing the river card. This dealing format may also be accomplished by the shuffling device, which may be indicated or not to players and the dealer. This would be done by the shuffler taking a next card from the set, deck or decks inserted into the shuffler, and moving the next card to a discard compartment.

When the fourth street card is provided, as noted before, the next top card in the set originally inserted to be randomized or shuffled, may be discarded (e.g., deposited within a discard compartment, ejected and placed in the discard tray, or assigned to another compartment (with or without other cards therein)) and then the fourth street card delivered to the delivery tray.

When the river card is provided, as noted before, the next top card in the set originally inserted to be randomized or shuffled, may be discarded (e.g., deposited within a discard compartment, ejected and discarded, or assigned to a compartment (with or without other cards therein)) and then the river card delivered to the delivery tray.

A similar operation and format of delivery may be made with the play of Omaha poker, where the players each receive four cards, and then the flop of three cards, a fourth street card and a river card.

In the use of a delivery shoe with automatic or mechanical card movement within the delivery shoe, as opposed a static shoe where the top card of a shuffled deck is removable by a dealer, the cards may be delivered according to a similar program, except that the cards may be provided from a shuffled deck, and the cards may be provided a delivery tray associated with the shoe, with the cards being provided in the number and interval that is programmed into the card-moving system for delivery to the card removal area. For example, in the deal of Texas Hold'Em, the delivery shoe would be modified such that it is equipped with a delivery tray and would be programmed to automatically deliver consecutive sets of two cards each to the delivery tray, and upon removal of those two cards, two more cards would be consecutively delivered for each player programmed into the system. The system would then deliver the three flop cards, and then the individual fourth street and river cards. The system may be programmed to provide burn cards intermediate the player cards, the flop, the fourth street card and the river card, or not.

In the delivery of cards for a game such as 3-5-7 POKER™, the program to the delivery shoe or shuffler would require that each of the player (and the dealer when there is play against the house) would receive a first set or segment of three cards as the hand to be played in the first interval of the game. Then the system would provide two additional cards to each of the players (and the house where receiving cards) to complete an intermediate five-card poker hand. The system would then provide a remaining set of two cards to each position to complete a seven-card poker hand. Additional rounds of wagering typically occur between the delivery of the sets of cards used to form intermediate and final hands.

After the cards have been distributed into the compartments, the first sets of cards to be delivered may be immediately placed in the delivery tray or the system may require dealer input or wagering input to initiate the dispensing of cards (e.g., an integrated system can read the placement of wagers, communicate the information to a central/intermediate/local processor and then to the shuffler, or to a processor in the shuffler (e.g., by wireless transmission or wired transmission)).

This apparatus is particularly useful in games that require multiple dealing rounds, and can utilize the present technology as described below.

The following example illustrates how a device of the present invention can be used to provide cards for a best five-out of seven-card poker game. The game is dealt in three segments.

Players make a wager and initially receive a set of three randomly arranged cards each to form a first partial three-card hand. The player views his cards and folds or makes a second wager. The shuffler then deals a second set of two cards each to each player to make a five-card hand. The player views the cards, and folds or makes a third bet. A third group or set of two cards each is dealt to make seven-card hands. The players discard two cards to make a best five-out of seven-card poker hand. The hands are resolved against a five-card poker pay table.

Each player receives a first set of three cards each, then a second set of two cards each, then a last set of two cards each. The shuffler preferably distributes the three subsets in one distribution process, the entire operation comprising a single shuffling cycle. A preferred shuffler would include a sufficient number of compartments to form all of the subsets needed in the game in a single distribution sequence. In this example, for a six-player table and no dealer cards, the shuffler would preferably have eighteen compartments plus at least one discard compartment.

When there are two or more times the number of compartments in the shuffler or randomizer or delivery system needed to distribute a group of cards to each player and dealer and/or common area, there are many more options available to the organization and format of delivery of cards. For example, consider an ONE2SIX® shuffler as shown in Blaha et al., U.S. Pat. Nos. 6,659,460 and 6,889,979 with a wheel having thirty-seven (37) compartments. With a first deck inserted into the card-receiving area, all of the cards needed for a round of play may be randomly distributed for a Texas Hold'Em game immediately. The cards may be distributed in subgroups of one, two and three cards, up to the limit of the 52 cards in the first deck. For example, there may be fifteen sets of two cards each and five sets of three cards each (for a total of 45 cards) and seven sets of one card each (for a total of 52 cards dispersed in twenty-two (22) compartments). This is merely an exemplary distribution and does not indicate any requirement or preference. The system, programming or design may use a single one of the compartments as the compartment to be deployed as the flop cards in all instances and/or specific compartments as the player cards and/or specific burn cards, river card or fourth street card, or the system may be programmed to randomly select from the compartments having the correct number of cards for the next distribution and then randomly select one of those appropriate compartments. For example, if compartments 1-15 had two cards each, and compartments 16-20 had three cards each, and 21-27 had one card each, then the flop could be provided by always using compartment 16, or the random number generator (or other randomizing function) would randomly choose between compartments 16-20 for each flop provision on each round of play. Similar analysis would apply to each player hand and any dealer hand provided.

Another advantage of providing a shuffler with a greater number of compartments (e.g., greater than twelve) is their capability of being used with separate decks at the same time. For example, in the use of the thirty-seven (37) compartment wheel, the distribution of a first deck could be eight compartments with two cards, ten compartments with three cards in each, and six compartments with one card in each, all from the first deck. The processor, having controlled the delivery and the location of each card, would know exactly what sum of compartments included the entire first deck. Even before dealing of the round of play from the first deck, the second deck may be inserted into the card-receiving area and the shuffler may begin distributing cards needed for play. In the beginning of this example, the wheel would have 15 remaining compartments with no cards therein. The processor could initiate a distinct loading process for eight compartments with two cards each, three compartments with three cards each, and four compartments with one card each. This would be sufficient in itself for the play of a subsequent round of play of Texas Hold'Em (except for the three burn cards) from the second deck only. In any event, once cards are unloaded from the first deck in the play of an earlier round of Texas Hold'Em, cards from the second deck may be loaded into the vacated compartments. Thus, when the first deck has been played and all remaining cards from the first deck delivered to the delivery tray or otherwise removed from the compartments, there is space for all of the cards from the second deck to be retained in compartments, with a same or different distribution of cards among the compartments.

Other features and advantages of the present invention will become more fully apparent and understood with reference to the following specification and to the appended drawings and claims.

This detailed description of the apparatus of a preferred shuffler is intended to be read and understood in conjunction with appended Appendices A, B and C, which are incorporated herein by reference. Appendix A provides an identification key correlating the description and abbreviation of certain motors, switches and photo eyes or sensors with reference character identifications of the same components in the figures, and gives the manufacturers, addresses and model designations of certain components (motors, limit switches and sensors). Appendix B outlines steps in a homing sequence, part of one embodiment of the sequence of operations as outlined in Appendix C.

With regard to means for fastening, mounting, attaching or connecting the components of the present invention to form the apparatus as a whole, unless specifically described as otherwise, such means are intended to encompass conventional fasteners such as machine screws, rivets, nuts and bolts, toggles, pins and the like. Other fastening or attachment means appropriate for connecting components include adhesives, welding and soldering, the latter particularly with regard to the electrical system of the apparatus.

All components of the electrical system and wiring harness of the present invention are conventional, commercially available components unless otherwise indicated, including electrical components and circuitry, wires, fuses, soldered connections, chips, boards and control system components.

Generally, unless specifically otherwise disclosed or taught, the materials for making the various components of the present invention are selected from appropriate materials such as metal, metallic alloys, ceramics, plastics, fiberglass and the like.

In the following description, the Appendices and the claims, any references to the terms "right" and "left", "top" and "bottom", "upper" and "lower" and "horizontal" and "vertical" are to be read and understood with their conventional meanings and with reference to viewing the apparatus generally from the front as shown in FIG. 1.

Figure 3:
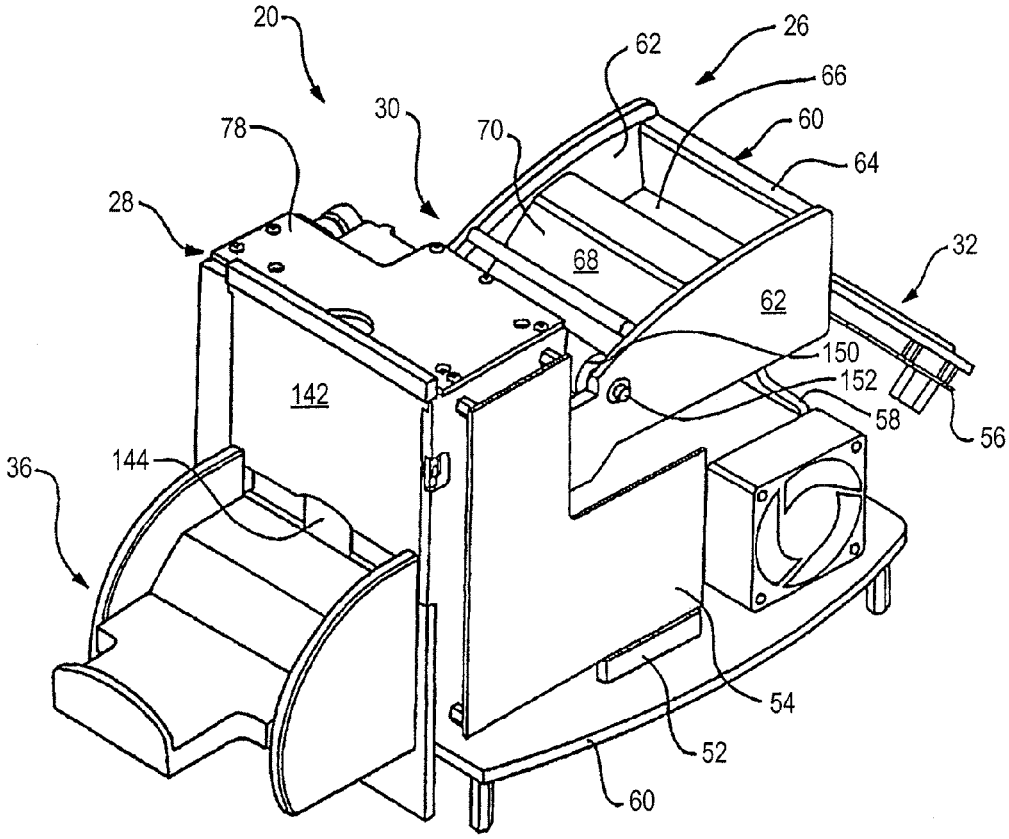
FIG. 3 is a front perspective view of a card-handling apparatus of the present invention with an exterior shroud removed.
Figure 4:
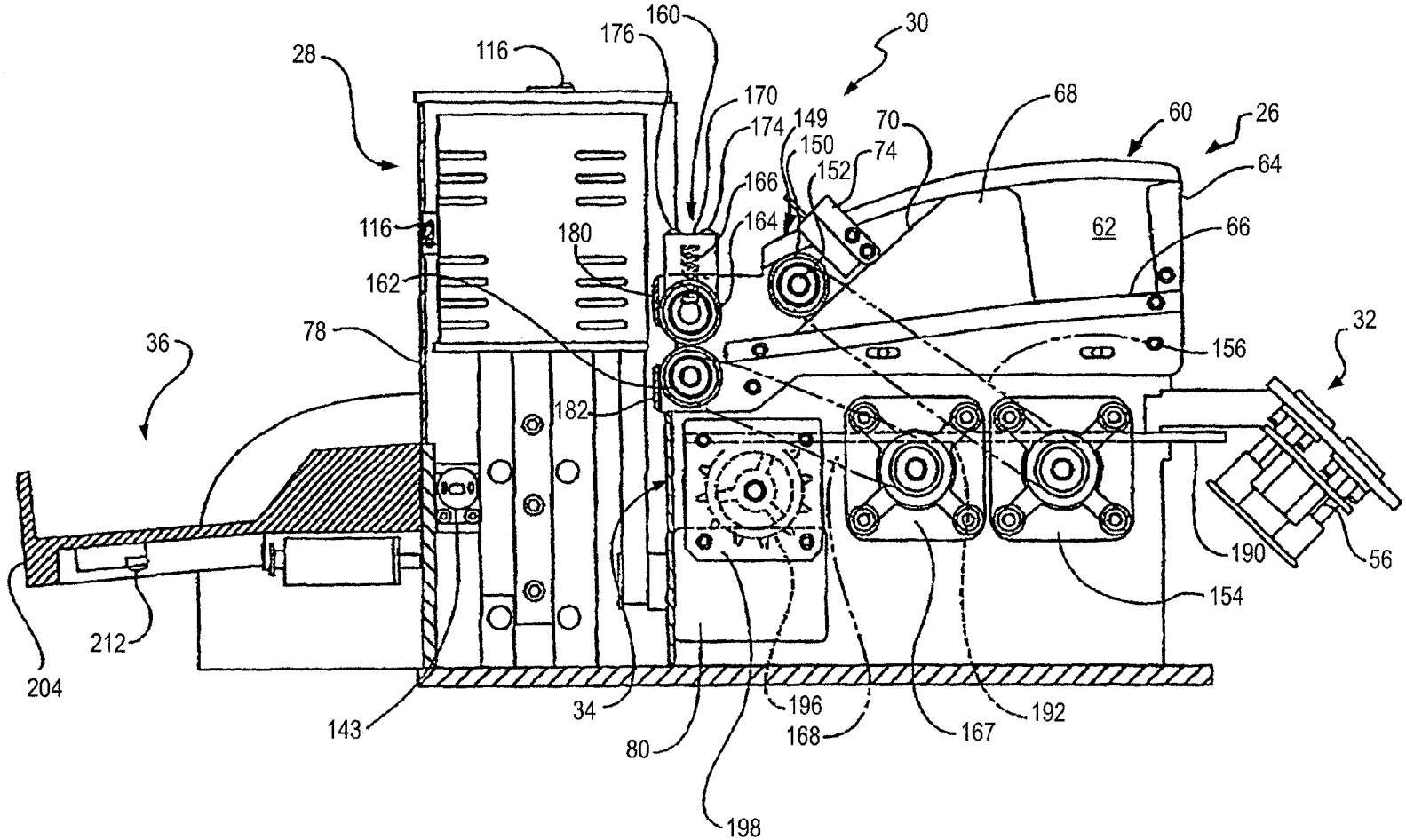
FIG. 4 is a side elevation view of the present invention with the shroud and other portions of the apparatus removed to show internal components.

Referring then to the figures, particularly FIGS. 1, 3 and 4, a preferred general format for a card-handling apparatus 20 of the present invention includes a card receiver 26 for receiving a group of cards, a single stack of card-receiving compartments 28 (see FIGS. 3 and 4) generally adjacent to the card receiver 26, a card-moving or transporting mechanism 30 between and linking the card receiver 26 and the compartments 28, and a processing unit, indicated generally at 32, that controls the apparatus 20. The apparatus 20 includes a second card mover 34 (see FIG. 4) for emptying the compartments 28 into a second receiver 36.

Figure 2:
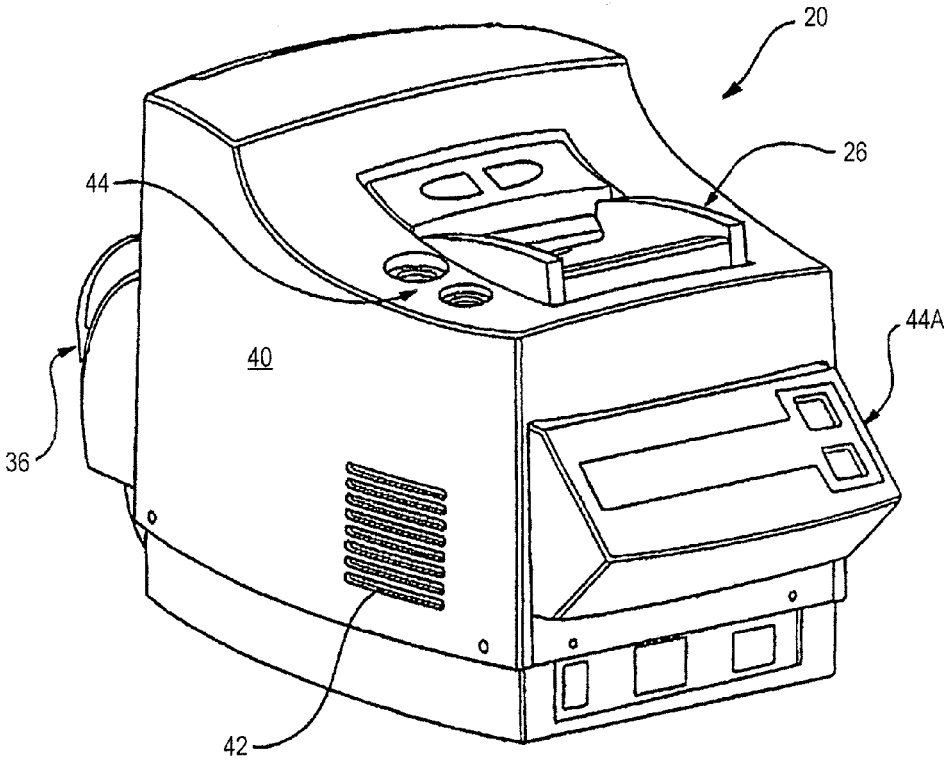
FIG. 2 is a rear perspective view depicting the apparatus of the present invention.

Referring now to FIG. 1, the card-handling apparatus 20 includes a removable, substantially continuous exterior housing or shroud 40. The exterior design features of the device of the present invention are disclosed in Design Patent Application Ser. No. 29/086,567, now issued as U.S. Design Pat. No. D414,527, filed on the same date as the present application, entitled "Device for Delivering Cards." The shroud 40 may be provided with appropriate vents 42 for cooling. The card receiver or initial loading region, indicated generally at 26, is at the top, rear of the apparatus 20, and a card- or hand-receiving platform 36 is at the front of the apparatus 20. Controls and/or display features 44 are generally located toward the rear or dealer-facing end of the machine 20. FIG. 2 provides a perspective view of the rear of the apparatus 20 and more clearly shows a display 44A and control inputs 44, including power input module/switch and a communication port.

FIG. 3 depicts the apparatus 20 with the shroud 40 removed, as it might be for servicing or programming, whereby the internal components may be visualized. The apparatus 20 includes a generally horizontal frame floor 50 and internal frame supports 54 for mounting and supporting operational components 52, such as an upright. A control (input and display) module 56 is cantilevered at the rear of the apparatus 20, and is operably connected to the operational portions of the apparatus 20 by suitable wiring 58. The inputs and display portion 44, 44A of the module 56 are fitted to corresponding openings in the shroud 40, with associated circuitry and programming inputs located securely within the shroud 40 when it is in place as shown in FIGS. 1 and 2.

Card Receiver

The card-loading region 26 includes a card-receiving well 60. The well 60 is defined by upright, generally parallel card-guiding side walls 62 and a rear wall 64. It includes a floor surface 66 pitched or angled downwardly toward the front of the apparatus 20. Preferably, the floor surface 66 is pitched from horizontal at an angle ranging from approximately 5 to 20 degrees, with a pitch of 7 degrees being preferred. A removable, generally rectangular weight or block 68 is generally freely movably received in the well 60 for free forward and rearward movement along the floor surface 66. Under the influence of gravity, the block 68 will tend to move toward the forward end of the well 60. The block 68 has an angled, card-contacting front face 70 for contacting the back (i.e., the bottom of the bottommost card) of a group of cards placed into the well 60, and urges cards (i.e., the top card of a group of cards) forward into contact with the card-transporting mechanism 30. The card-contacting front face 70 of the block 68 is at an angle complementary to the floor surface 66 of the well 60, for example, an angle of between approximately 10 and 80 degrees, and this angle and the weight of the block 68 keep the cards urged forwardly against the transport mechanism 30. The selected angle of the floor 66 and the weight of the block 68 allow for the free floating rearward movement of the cards and the block 68 to compensate for the forces generated as the transport mechanism 30 contacts the front card to move it. The well 60 includes a card-present sensor 74 (see FIG. 4) to sense the presence or absence of cards in the well 60. Preferably, the block 68 is mounted on a set of rollers, which allows the block 68 to glide more easily along floor surface 66 and/or the floor surface 66 and floor contacting bottom of the block 68 may be formed of or coated with suitable low friction materials.

Card-Receiving Compartments

Figure 9:
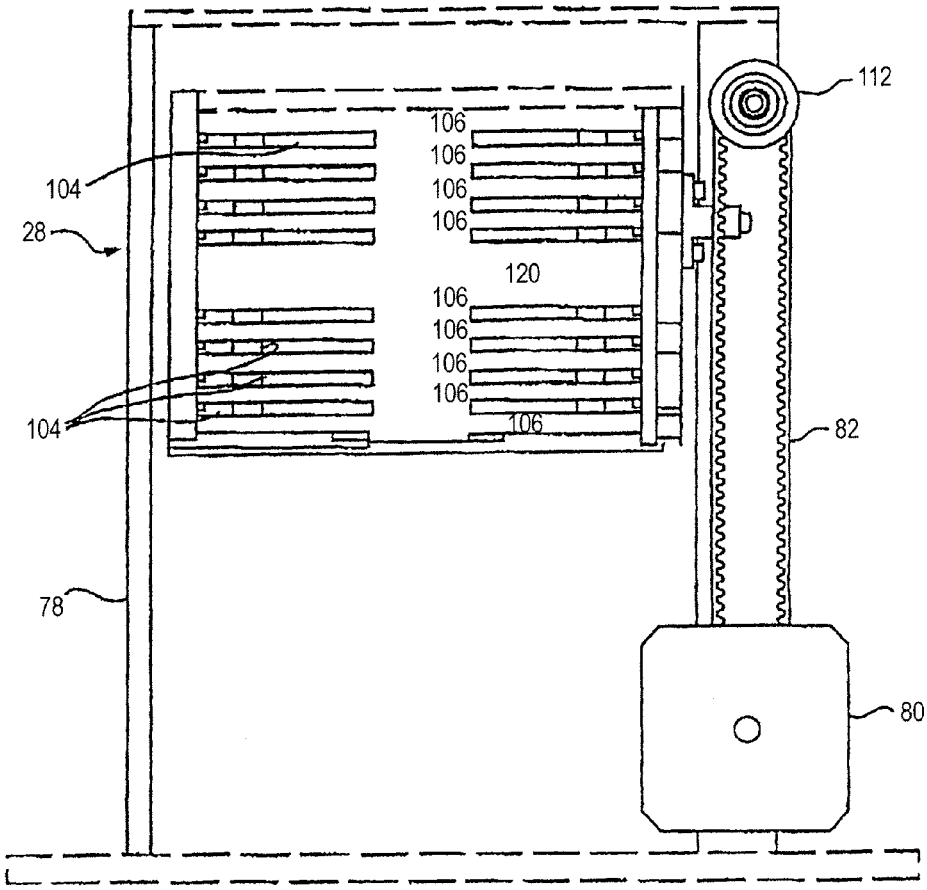
FIG. 9 is a front elevation view of a rack and elevator assembly.
Figure 10:
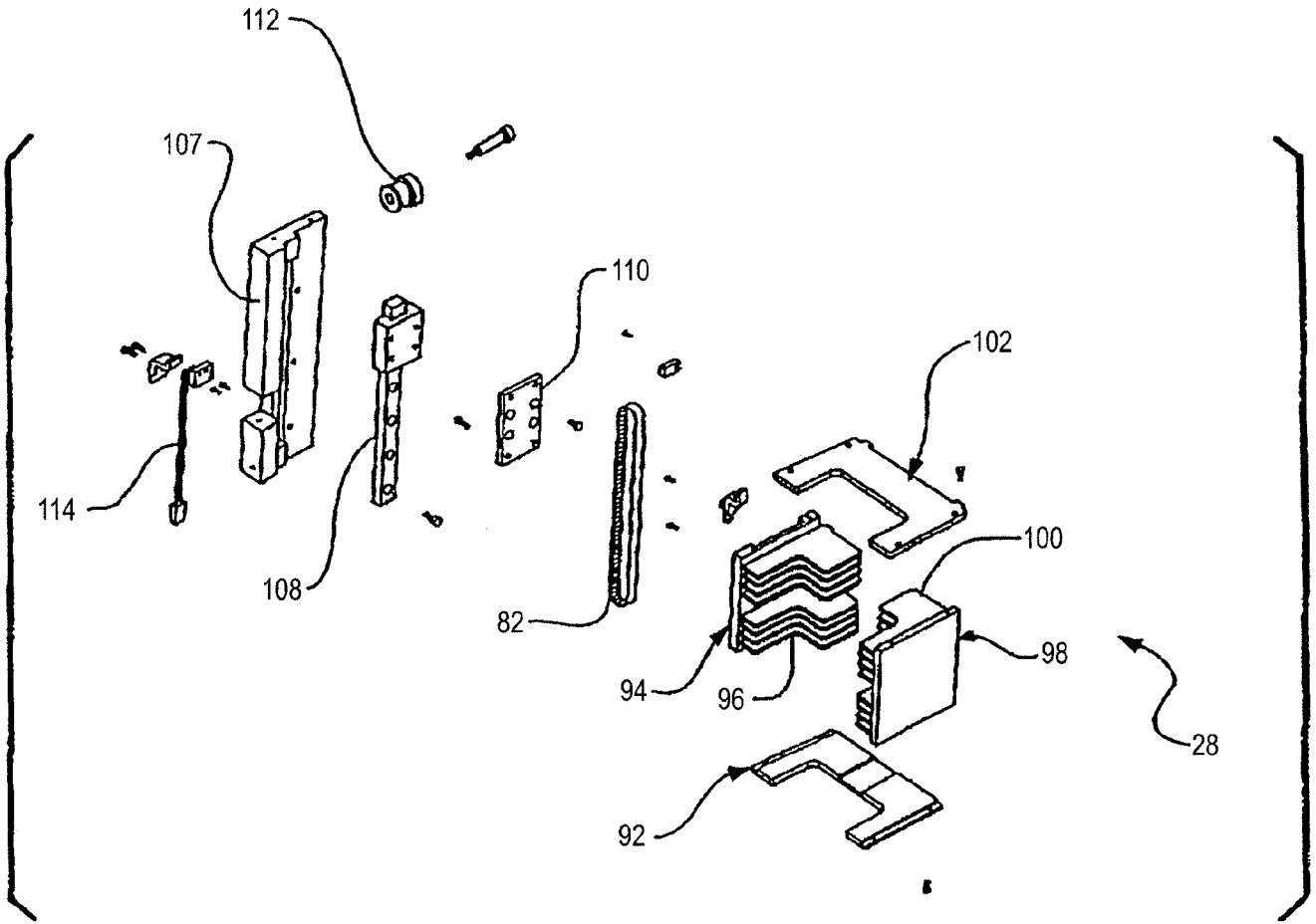
FIG. 10 is an exploded view of the rack and elevator assembly.

A first preferred assembly or stack of card-receiving compartments 28 is depicted in FIGS. 9 and 10, and for purposes of this disclosure is also referred to as a rack assembly. Referring back to FIG. 3, the rack assembly 28 is housed in an elevator and rack assembly housing 78 generally adjacent to the well 60, but horizontally spaced therefrom. An elevator motor 80 is provided to position the rack assembly 28 vertically under control of a microprocessor, which microprocessor is generally part of the processing unit 32. The motor 80 is linked to the rack assembly 28 by a timing belt 82. Referring now to FIG. 10, the rack assembly 28 includes a bottom plate 92, a left hand rack 94 carrying a plurality of half shelves 96, a right hand rack 98 including a plurality of half shelves 100 and a top plate 102. Together the right and left hand racks 94, 98 and their respective half shelves 96, 100 form the individual plate-like shelf pieces or members 104 for forming the top and bottom walls of individual compartments 106.

Preferably, the rack assembly 28 has nine compartments 106. Seven of the nine compartments 106 are for forming complete player hands, one compartment 106 forms a complete dealer hand and the last compartment 106 is for accepting unused or discard cards. It should be understood that the device of the present invention is not limited to a rack assembly with seven to nine compartments 106. For example, although it is possible to achieve a random distribution of cards delivered to eight compartments with a 52-card deck or group of cards, if the number of cards per initial unshuffled group is greater than 52, more compartments than nine may be provided to achieve sufficient randomness in eight formed hands. Also, additional compartments may be provided to form hands or partial hands for a gaming table having more than seven player positions. For example, some card rooms and casinos offer stud poker games for up to twelve people at a single table. The apparatus 20 may then have thirteen compartments, as traditional poker does not permit the house to play, with at least one compartment dedicated to collect unused cards.

In each example of the present invention, at least one stack of unused cards is formed that may not be sufficiently randomized for use in a card game. These unused cards should be returned to the card receiver 26 (FIG. 1) for distribution in the next cycle.

The rack assembly 28 is operably mounted to the apparatus 20 by a left side rack plate 107 and a linear guide 108. The rack assembly 28 is attached to the linear guide 108 by means of a guide plate 110. The belt 82 is driven by the motor 80 and engages a pulley 112 for driving the rack assembly 28 up and down. A Hall Effect switch assembly 114 is provided to sense the location of the rack assembly 28. The rack assembly 28 may carry a card-present sensor 116 mounted to an underside of elevator and rack assembly housing 78 (see FIG. 4) and which is electrically linked to the microprocessor.

FIG. 9 depicts a rack assembly 28 having nine individual compartments 106 including a comparatively larger central compartment 120 for receiving discard or unused cards.

Figure 9A:
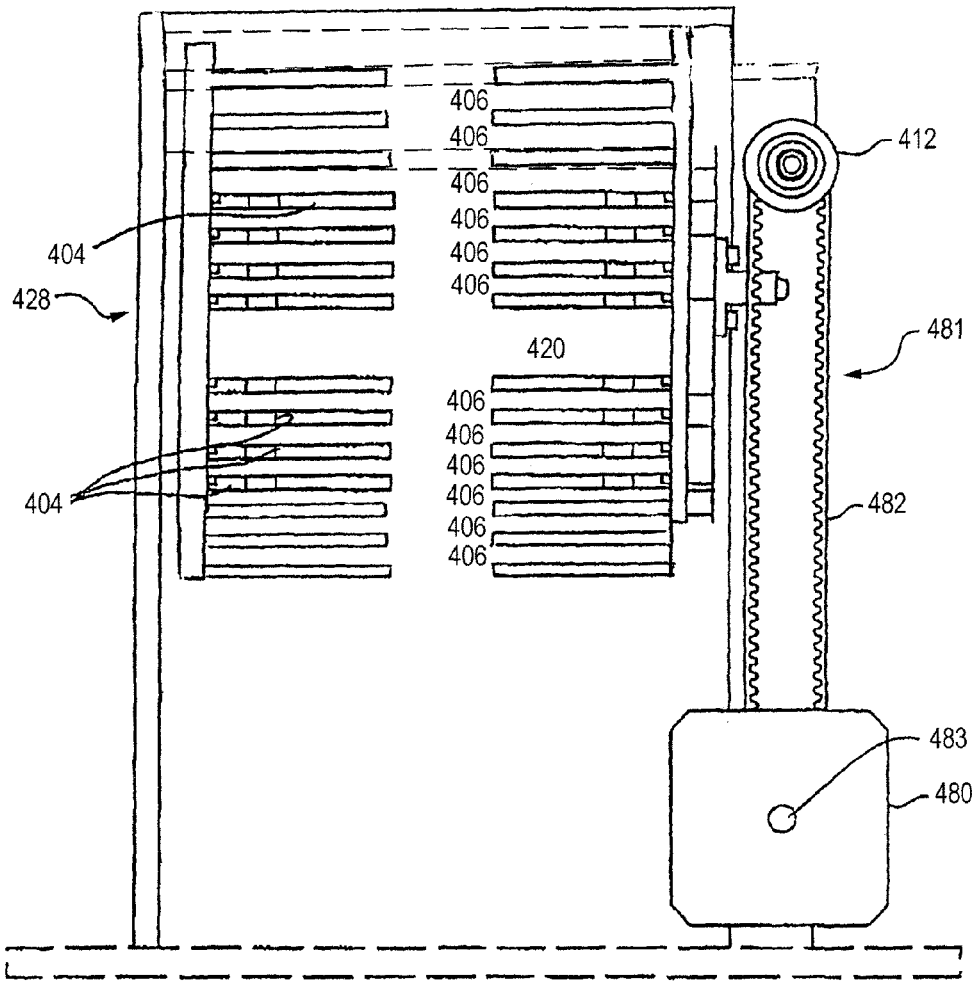
FIG. 9A is a front elevational view of an alternate rack and elevator assembly.

FIG. 9A shows an alternative rack structure 428 that allows for the distribution of two sets of cards per hand to a six-player table game (the dealer in this example does not receive cards). There are twelve set-forming compartments 406 defined by plates 404 and a single discard compartment 420. A motor 480 drives an elevator 481. Sprocket 412 carries toothed endless element 482 and is driven by a drive sprocket (not shown) mounted to rotational motor shaft 483.

Figure 7:
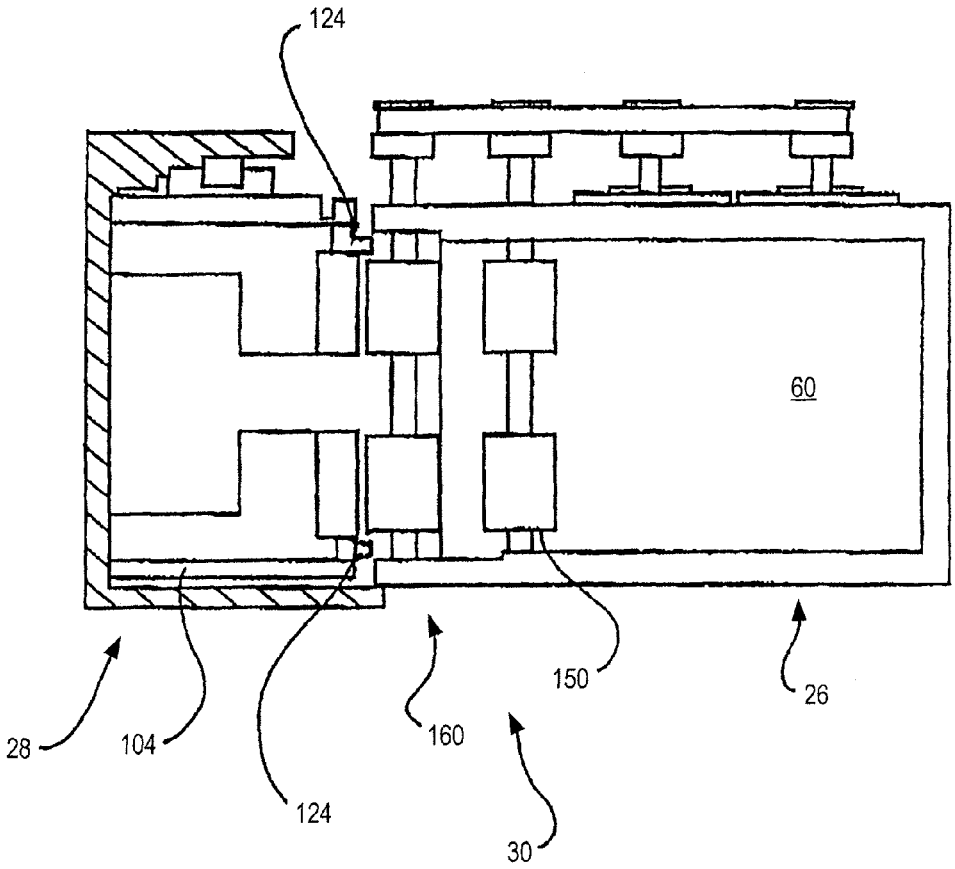
FIG. 7 is a top plan view, partially in section, of the transport mechanism.

FIG. 7 provides a top plan view of one of the plate-like shelf members 104 and shows that each one includes a pair of rear tabs 124. The tabs 124 align a leading edge of the card with an opening in the compartment so that the cards are moved from the transporting mechanism 30 into the rack assembly 28 without jamming.

Figure 11:
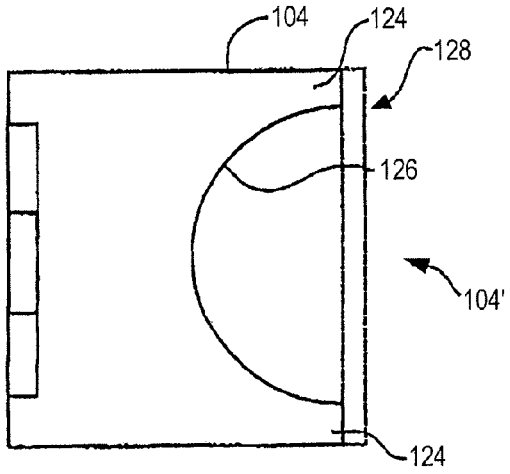
FIG. 11 depicts an alternative embodiment of shelves or partitions for forming a stack of compartments of the present invention.

FIG. 11 depicts an alternative embodiment of plate-like shelf members 104 comprising a single-piece plate member 104'. An appropriate number of the single-piece plates, corresponding to the desired number of compartments 106 are connected between the side walls of the rack assembly 28 (see FIG. 9). The plate 104' depicted in FIG. 11 includes a curved or arcuate edge portion 126 on the rear edge 128 for removing cards or clearing jammed cards, and also includes the two bilateral tabs 124, also a feature of the shelf members 104 of the rack assembly 28 depicted in FIG. 7. The tabs 124 act as card guides and permit the plate-like shelf members 104 forming the compartments 106 to be positioned effectively as closely as possible to the card-transporting mechanism 30 to ensure that cards are delivered into the selected compartment 106 (or 120) even though they may be warped or bowed.

Referring back to FIG. 5, an advantage of the plates 104 (and/or the half plates 96, 100 (FIG. 10)) forming the compartments 106, 120 is depicted. Each plate 104 includes a beveled or angled underside rearmost surface 130 in the space between the shelves or plates 104, i.e., in each compartment 106, 120. The distance between a forward edge 132 of the beveled surface 130 and a forward edge 134 of a shelf 104 preferably is less than the width of a typical card. As shown in FIG. 5A, a leading edge 136 of a card being driven into a compartment 106, 120 hits the beveled surface 130 and is driven by the card onto the top of the stack supported by next shelf member 104. To facilitate forming a beveled suface 130 at a suitable angle θ 137 and of a suitable size, a preferred thickness for the plate-like shelf members 104 is approximately 3/32 of an inch, but this thickness and/or the bevel angle 137 can be changed or varied to accommodate different sizes of cards, such as poker and bridge cards. Preferably, the bevel angle 137 is between 10 degrees and 45 degrees, and most preferably is approximately 15 degrees to 20 degrees. Whatever bevel angle and thickness is selected, it is preferred that cards should come to rest with their trailing edge rearward of the forward edge 132 of the bevel 130.

Figure 12:
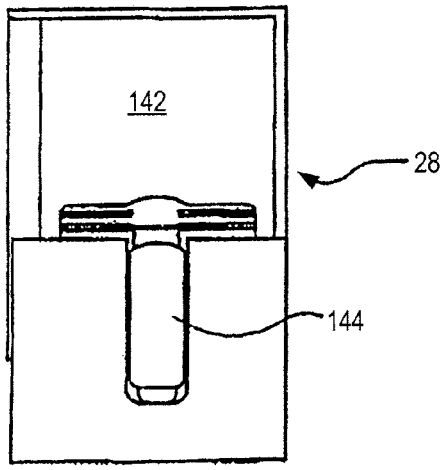
FIG. 12 depicts a card stop in an open position.
Figure 13:
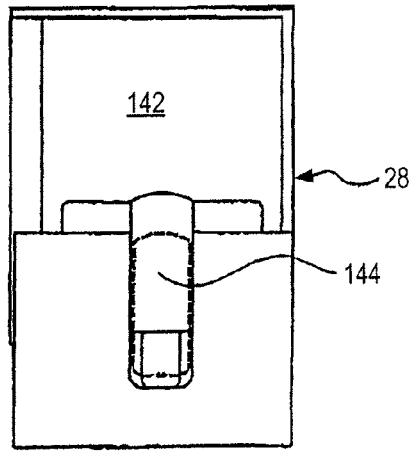
FIG. 13 depicts a card stop in a closed position.

Referring now to the FIGS. 12 and 13, the front portion of the rack assembly 28 includes a solenoid operated gate 142 and a card stop 144 for controlling the unloading of the cards into the second receiver 36 (FIG. 1). Although a separate, vertically movable gate 142 and card stop 144 are depicted, the function, stopping the forward movement of the cards, could be accomplished either by a lateral moving gate or card stop alone (not shown) or by other means. In FIG. 13, the card stop 144 is shown in its raised position and FIG. 12 depicts it in its lowered open position. The position of the gate 142 and card stop 144 is related by the microprocessor to the rack assembly 28 position.

Card-Moving Mechanism

Figure 5:
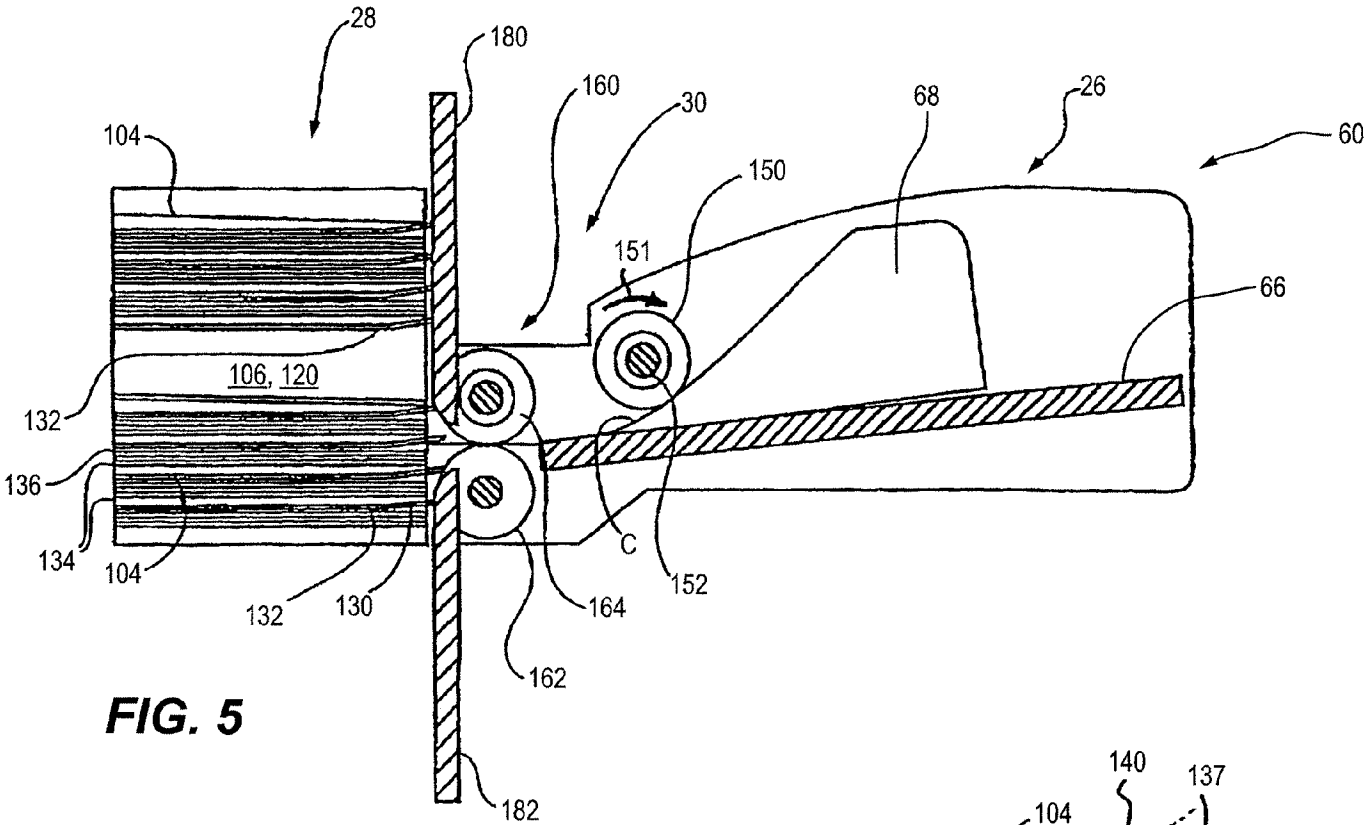
FIG. 5 is a side elevation view, largely representational, of the transport mechanism of the apparatus of the present invention.
Figure 5A:
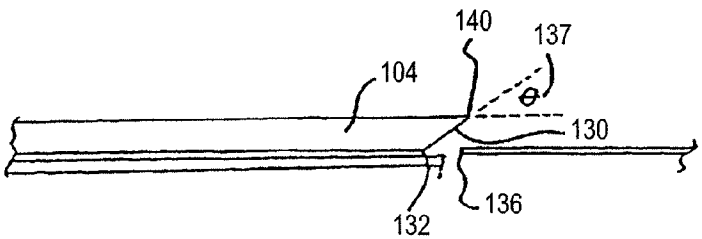
FIG. 5A is an enlarged cross-sectional view of one of the card-receiving compartments of FIG. 5.
Figure 6:
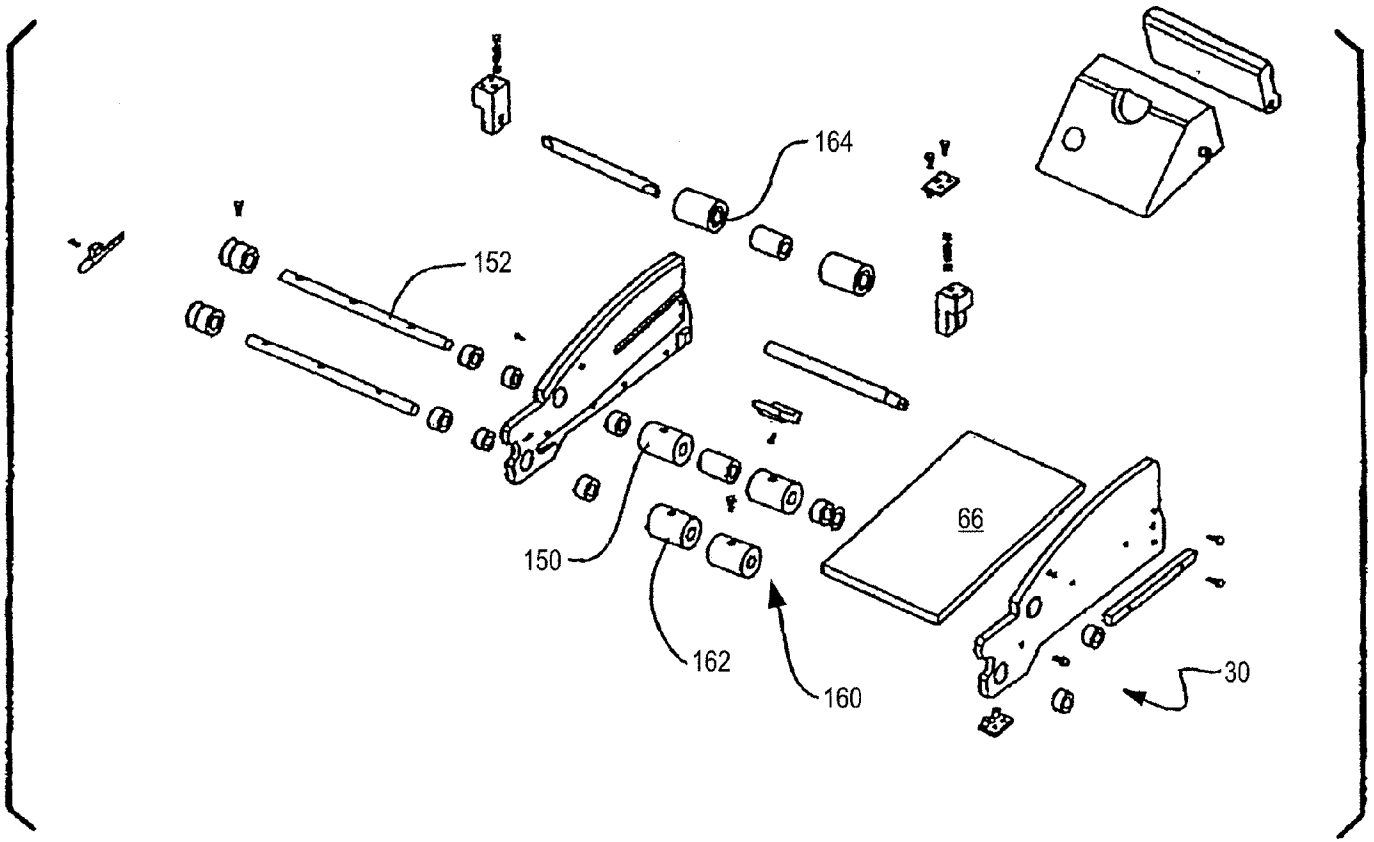
FIG. 6 is an exploded assembly view of the transport mechanism.

Referring now to FIGS. 4, 5 and 6, a preferred card-transporting or moving mechanism 30 is positioned between the card-receiving well 60 and the compartments 106, 120 of the rack assembly 28 and includes a card pick-up roller assembly 149. The card pick-up roller assembly 149 includes a pick-up roller 150 and is located generally at the forward portion of the well 60. The pick-up roller 150 is supported by a bearing mounted axle 152 extending generally transversely across the well 60 whereby the card-contacting surface of the pick-up roller 150 is in close proximity to the forward portion of the floor surface 66. The pick-up roller 150 is driven by a pick-up motor 154 operably coupled to the axle 152 by a suitable continuous connector 156 such as a belt or chain. In operation the front card in the well 60 is urged against the pick-up roller 150 by block 68 that when the pick-up roller 150 is activated, the frictional surface draws the front card downwardly and forwardly.

Referring now to FIGS. 4 and 5, the preferred card-moving mechanism 30 also includes a pinch roller card accelerator or speed-up system 160 located adjacent to the front of the well 60 between the well 60 and the rack assembly 28 and forwardly of the pick-up roller 150. The speed-up system 160 comprises a pair of axle supported, closely adjacent speed-up rollers, one above the other, including a lower roller 162 and an upper idling roller 164. The upper idling roller 164 is urged toward the lower roller 162 by a spring assembly 166. Alternatively, it may be weighted or drawn toward the lower roller 162 by a resilient member (not shown). The lower roller 162 is driven by a speed-up motor 167 operably linked to the lower roller 162 by a suitable connector 168 such as a belt or a chain. A mounting bracket 170 for the speed-up rollers also supports a rearward card-in sensor 174 and a forward card-out sensor 176. FIG. 5 is a largely representational view depicting the relationship between the card-receiving well 60 and the card-transporting mechanism 30, and also shows a card "C" being picked up by the pick-up roller 150 moving in rotational direction 151 and being moved into the pinch roller system 160 for acceleration into a compartment 104 of the rack assembly 28 (see FIG. 9).

In the preferred embodiment, the pick-up roller 150 is not continuously driven, but rather indexes and includes a one-way clutch mechanism. After initially picking up a card and advancing it into the pinch roller card accelerator 160, the pick-up motor 154 operably coupled to the pick-up roller 150 stops driving the roller, and the pick-up roller 150 free-wheels as the card is accelerated through the pinch roller card accelerator 160. The speed-up pinch roller card accelerator 160 is preferably continuous in operation once a hand-forming cycle starts and, when a card is sensed by the adjacent card-out sensor 176, the pick-up roller 150 stops and free-wheels while the card is accelerated through the pinch roller card accelerator 160. When the trailing edge of the card is sensed by the card-out sensor 176, the rack assembly 28 moves to the next position for the next card and the pick-up roller 150 is re-activated.

Additional components and details of the transport mechanism 30 are depicted in FIG. 6, an exploded assembly view thereof. In FIG. 6 the inclined floor surface 66 of the well 60 is visible, as are the axle mounted pick-up and pinch roller card accelerator 150, 160, respectively, and their relative positions.

Referring to FIGS. 4 and 5, the transport assembly 30 includes a pair of generally rigid stopping plates including an upper stop plate and a lower stop plate, 180, 182, respectively. The plates 180, 182 are positioned between the rack assembly 28 and the speed-up system 160 immediately forward of and above and below the pinch rollers 162, 164. The stop plates 180, 182 stop the cards from rebounding or bouncing rearwardly, back toward the pinch rollers, 162, 164, as they are driven against and contact the gate 142 and/or the card stop 144 at the front of the rack assembly 28.

Processing/Control Unit

Figure 16:
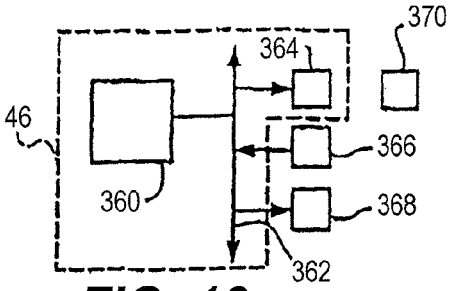
FIG. 16 is a schematic diagram of an electrical control system for one embodiment of the present invention.

FIG. 16 is a block diagram depicting an electrical control system which may be used in one embodiment of the present invention. The control system includes a controller 360, a bus 362, and a motor controller 364. Also represented in FIG. 16 are inputs 366, outputs 368, and a motor system 370. The controller 360 sends signals to both the motor controller 364 and the outputs 368, while monitoring the inputs 366. The motor controller 364 interprets signals received over the bus 362 from the controller 360. The motor system 370 is driven by the motor controller 364 in response to the commands from the controller 360. The controller 360 controls the state of the outputs 368 and the state of the motor controller 364 by sending appropriate signals over the bus 362.

The inputs 366 in one embodiment are in communication with an external display and user input 44*a* (shown in FIG. 2) that can be used to input the number of players at a table, the number of cards dealt per person, the number of cards/segment and the number of segments/round. The user input/display may also be located on the table rather than on the shuffler.

In a preferred embodiment of the present invention, the motor system 370 comprises motors that are used for operating components of the card-handling apparatus 20. Motors operate the pick-up roller, the pinch, speed-up rollers, the pusher and the elevator. The gate and stop may be operated by a motor, as well. In such an embodiment, the motor controller 364 would normally comprise one or two controllers and driver devices for each of the motors used. However, other configurations are possible.

The outputs 368 include, for example, alarm, start, and reset indicators and inputs and may also include signals that can be used to drive a display device (e.g., an LED display—not shown). Such a display device can be used to implement a timer, a card counter, or a cycle counter. Generally, an appropriate display device can be configured and used to display any information worthy of display.

The inputs 366 contain information from the limit switches and sensors described above as well as user inputs. The controller 360 receives the information from the inputs 366 over the bus 362.

Figure 17:
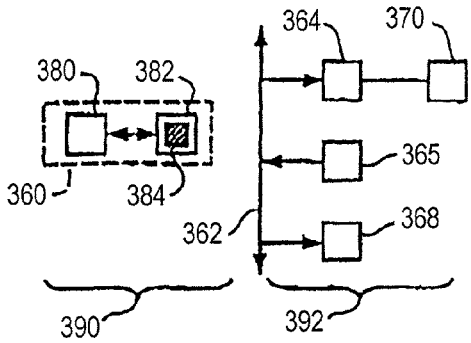
FIG. 17 is a schematic diagram of the electrical control system.

Although the controller 360 can be any digital controller or microprocessor-based system, in a preferred embodiment, the controller 360 comprises a processing unit 380 and a peripheral device 382 as shown in FIG. 17. The processing unit 380 in a preferred embodiment may be an 8-bit single-chip microcomputer such as an 80052 manufactured by the Intel Corporation of Santa Clara, Calif. The peripheral device 382 may be a field programmable micro controller peripheral device that includes programmable logic devices, EPROMs, and input-output ports. As shown in FIG. 17, peripheral device 382 serves as an interface between the processing unit 380 and the bus 362.

The series of instructions are stored in the controller 360 as shown in FIG. 17 as program logic 384. In a preferred embodiment, the program logic 384 is RAM or ROM hardware in the peripheral device 382. (Since the processing unit 380 may have some memory capacity, it is possible that some of the instructions may be stored in the processing unit 380.) As one skilled in the art will recognize, various implementations of the program logic 384 are possible. The program logic 384 could be either hardware, software, or a combination of both. Hardware implementations might involve hard-wired code or instructions stored in a ROM or RAM device. Software implementations would involve instructions stored on a magnetic, optical, or other media that can be accessed by the processing unit 380.

Under certain conditions, it is possible that a significant amount of electrostatic charge may build up in the card handler 20 (FIG. 1). Significant electrostatic discharge could affect the operation of the card handler 20. It is preferable to isolate some of the circuitry of the control system from the rest of the machine. In a preferred embodiment of the present invention, a number of optically coupled isolators are used to act as a barrier to electrostatic discharge.

Figure 18:
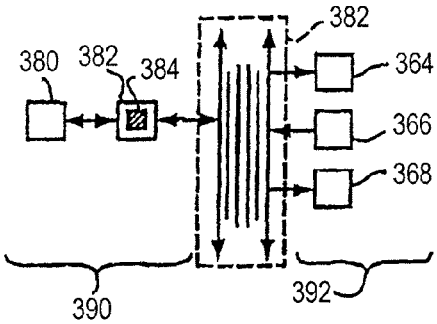
FIG. 18 is a schematic diagram of an electrical control system with an optically isolated bus.
Figure 19:
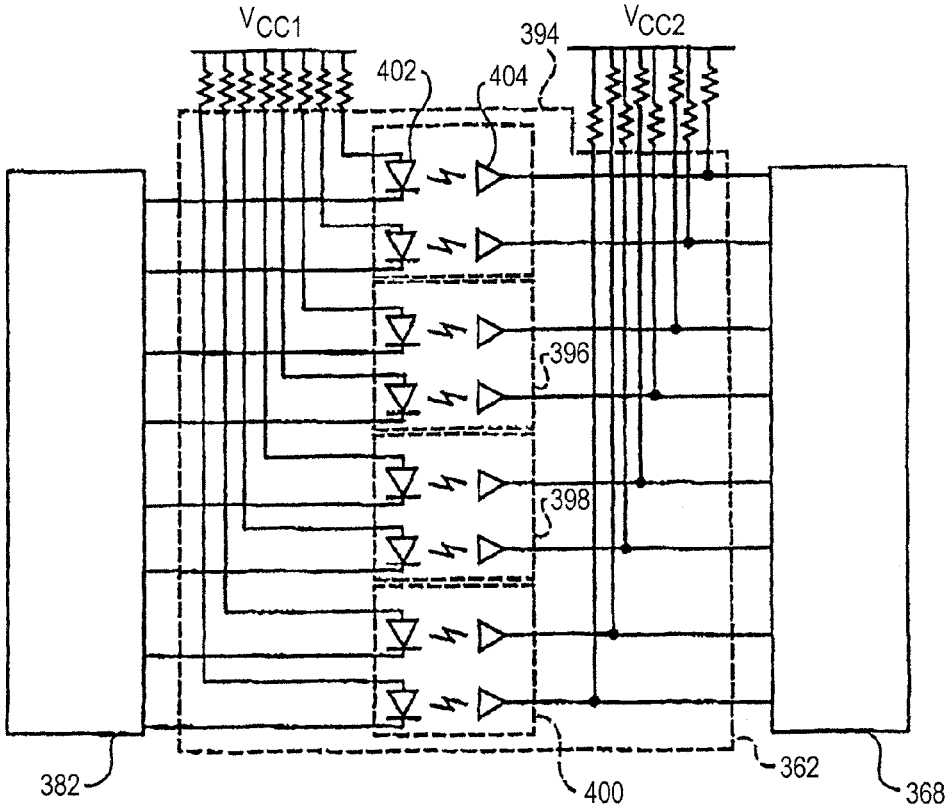
FIG. 19 is a detailed schematic diagram of a portion of the electrical control system illustrated in FIG. 18.

As shown in FIG. 18, a first group of circuitry 390 can be electrically isolated from a second group of circuitry 392 (see also FIG. 17) by using optically coupled logic gates that have light-emitting diodes to optically (rather than electrically) transmit a digital signal, and photo detectors to receive the optically transmitted data. An illustration of electrical isolation through the use of optically coupled logic gates is shown in FIG. 19, which shows a portion of FIG. 18 in greater detail. Four Hewlett-Packard HCPL-2630 optocouplers (labeled 394, 396, 398 and 400) are used to provide an 8-bit isolated data path to the output devices 368. Each bit of data is represented by both an LED 402 and a photo detector 404. The LEDs emit light when energized and the photo detectors detect the presence or absence of the light. Data may thus be transmitted without an electrical connection.

Second Card-Moving Mechanism

Figure 8:
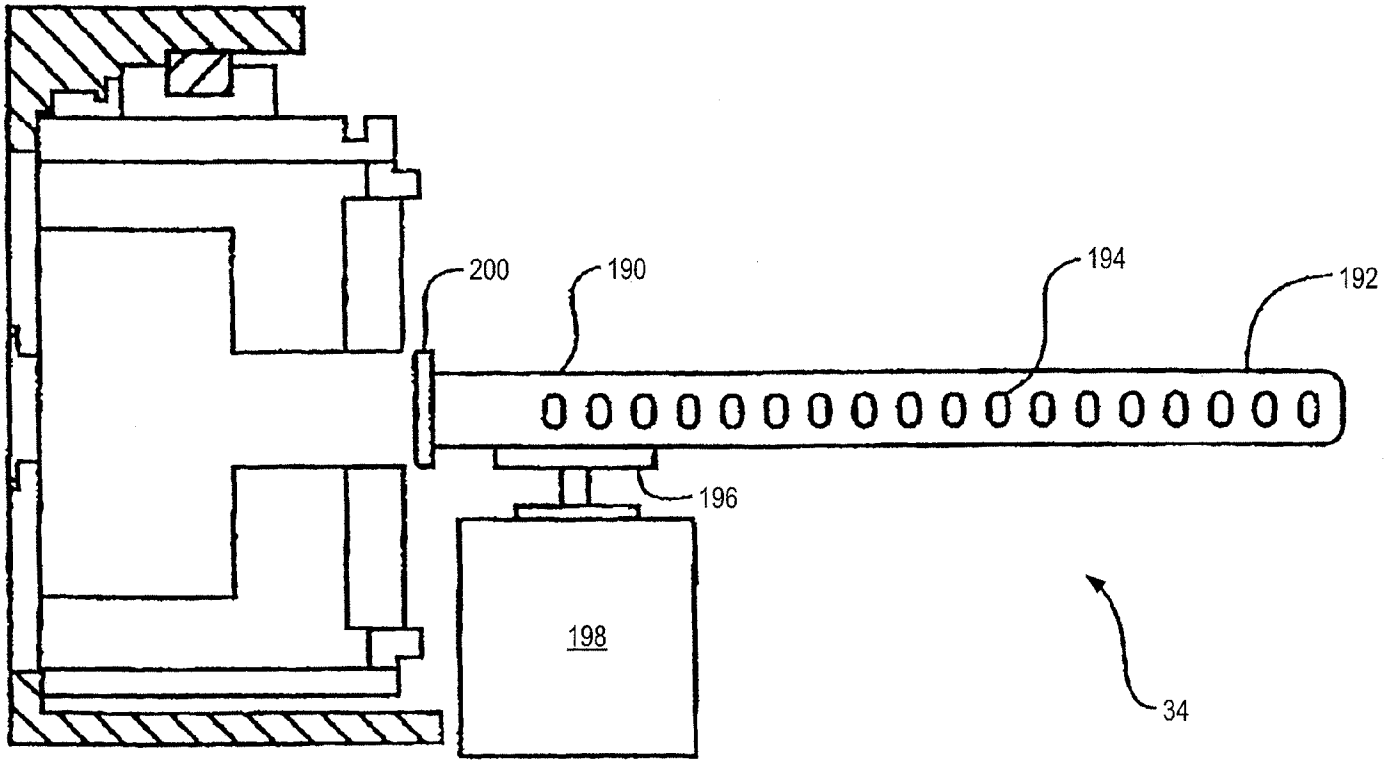
FIG. 8 is a top plan view of a pusher assembly of the present invention.

Referring to FIGS. 4 and 8, the apparatus 20 (FIG. 1) includes a second card-moving mechanism 34 comprising a reciprocating card compartment unloading pusher 190. The pusher 190 includes a substantially rigid pusher arm 192 in the form of a rack having a plurality of linearly arranged apertures 194 along its length. The arm 192 operably engages the teeth of a pinion gear 196 driven by an unloading motor 198, which is in turn controlled by the microprocessor 360 (FIGS. 16 and 17). At its leading or card-contacting end, the pusher arm 192 includes a blunt, enlarged card-contacting end portion 200. The end portion 200 is greater in height than the space between the shelf members 104 forming the compartments 106 to make sure that all the cards (i.e., the hand) contained in a selected compartment are contacted and pushed out as it is operated, even when the cards are bowed or warped. The second card-moving mechanism 34 is operated intermittently (upon demand or automatically) to empty full compartments 106 at or near the end of a cycle.

Second Card/Hand Receiver

When actuated, the second card-moving mechanism 34 empties a compartment 106, 120 by pushing the group of cards therein into a card-receiving platform 36. The card-receiving platform 36 is shown in FIGS. 1, 4, 14 and 15, among others.

Figure 15:
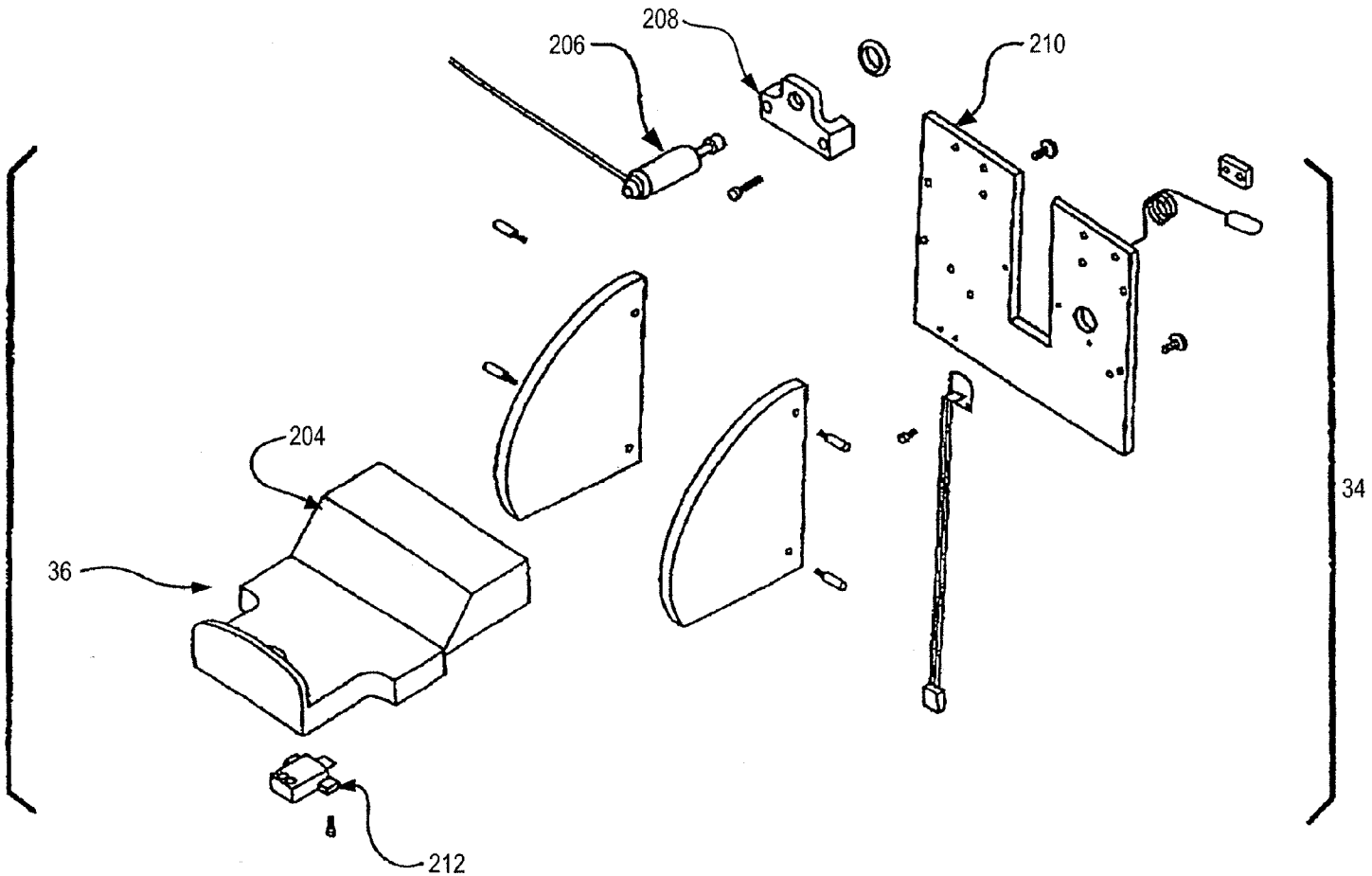
FIG. 15 is an exploded view of a card- or hand-receiving assembly of the apparatus of the present invention.

Referring to FIG. 15, the second card- or hand-receiving platform 36 includes a shoe plate 204 and a solenoid assembly 206, including a solenoid plate 208, carried by a rear plate 210, which is also the front plate of the rack assembly 28. The shoe plate 204 also carries an optical sensing switch 212 for sensing the presence or absence of a hand of cards and for triggering the microprocessor to drop the gate 142 and actuate the pusher 190 of the second card-moving mechanism 34 to unload another hand of cards from a compartment 106, 120 when the hand receiver 36 is empty. In a first preferred embodiment, the player hands are unloaded sequentially. After the dealer receives his hand, he or she presses a button that instructs any remaining hands and the discard pile to unload. According to a second preferred embodiment, the microprocessor is programmed to randomly select and unload all player hands, then the dealer hand, and last the discard pile.

Figure 14:
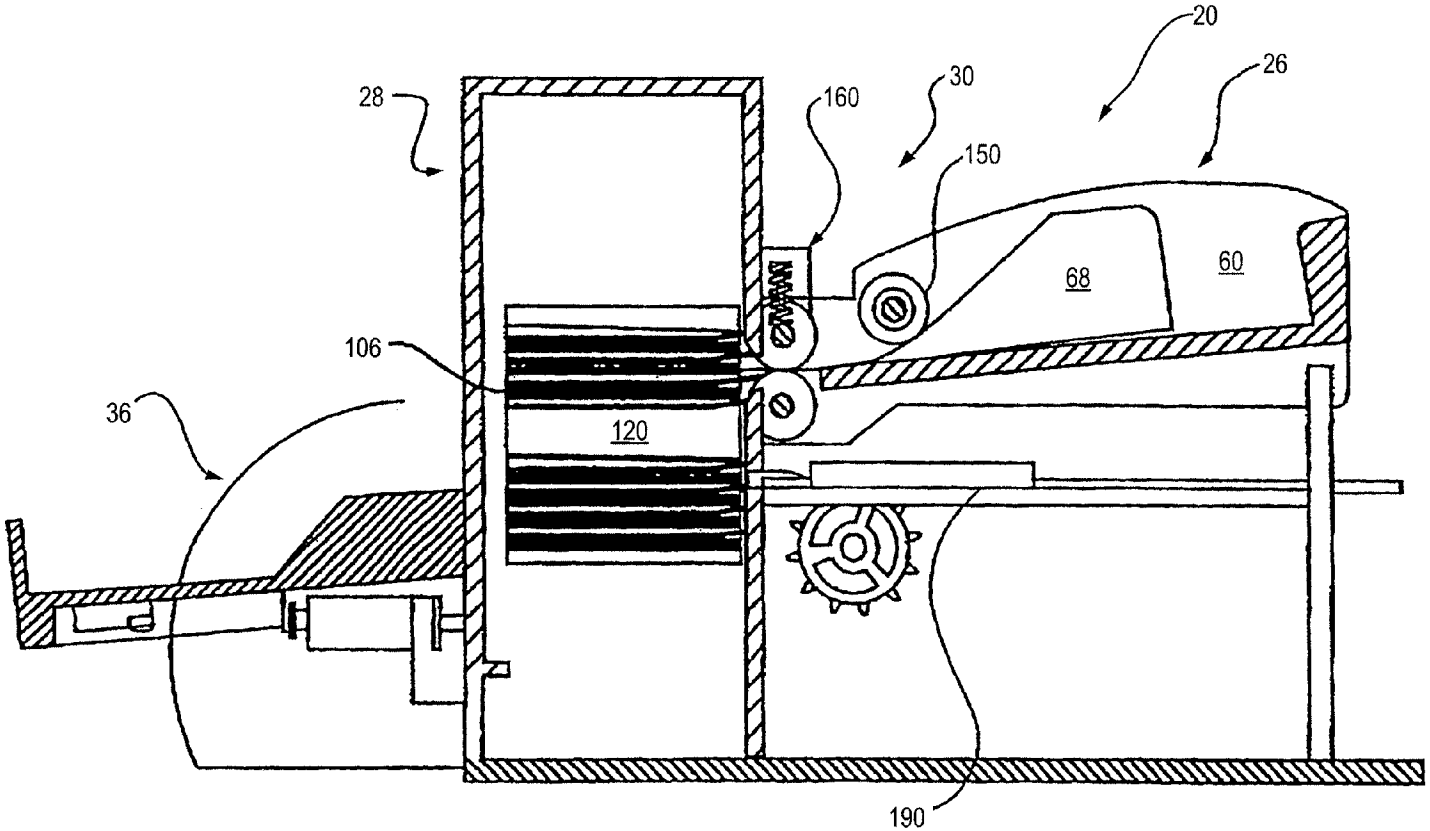
FIG. 14 is a simplified side elevation view, largely representational, of the card-handling apparatus of the present invention.

FIG. 14 is a largely representational view depicting the apparatus 20 and the relationship of its components including the card receiver 26 for receiving a group of cards for being formed into hands or partial hands, including the well 60 and block 68, the rack assembly 28 and its single stack of card-receiving compartments 106, 120, the card-moving or transporting mechanism 30 between and linking the card receiver 26 and the rack assembly 28, the second card mover 190 for emptying the compartments 106, 120, and the second receiver 36 for receiving hands of cards.

Alternative Embodiments

Figure 20:
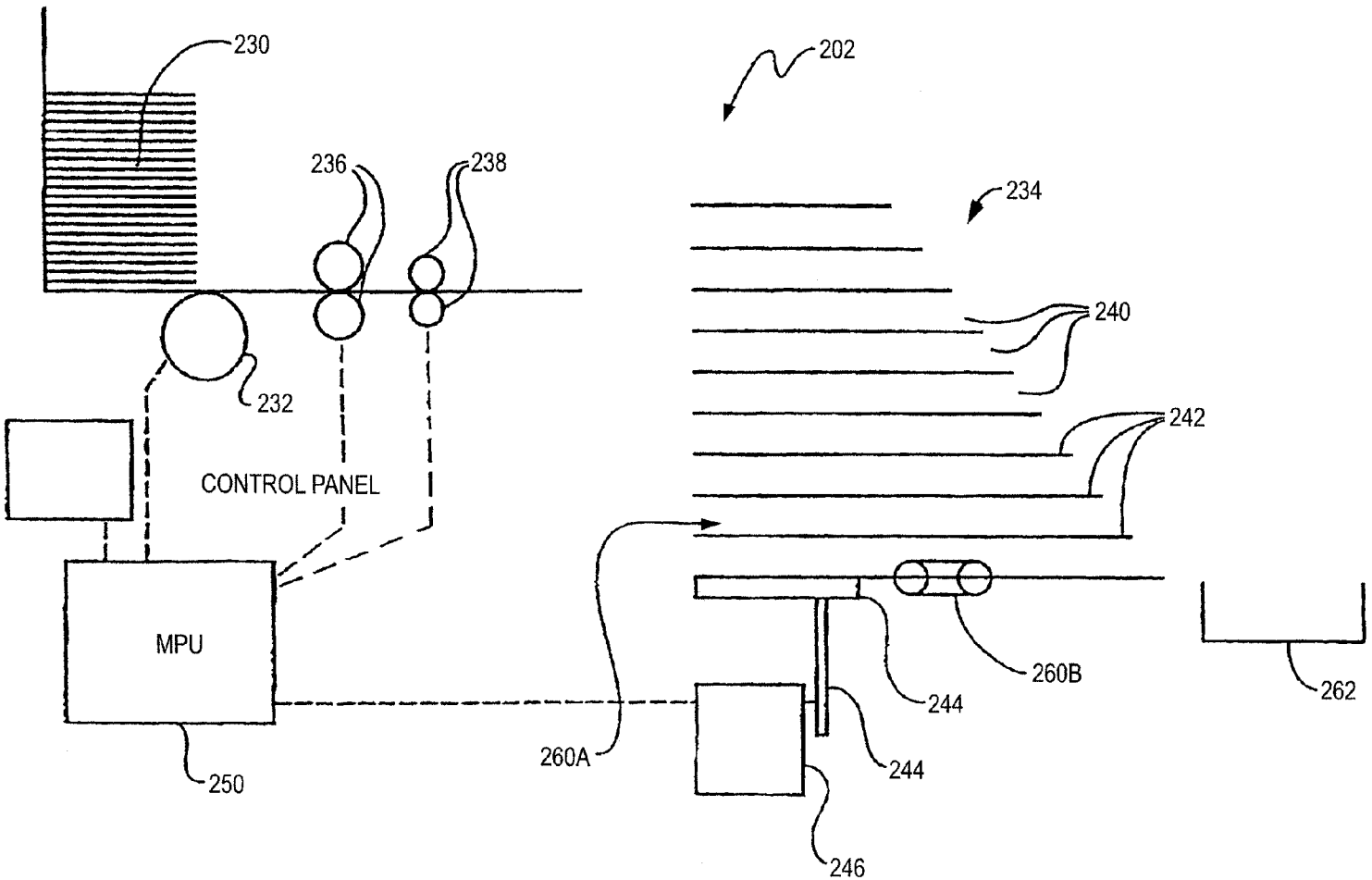
FIG. 20 schematically depicts an alternative embodiment of the apparatus of the present invention.

FIG. 20 represents an alternative embodiment of the present invention wherein the card handler 202 includes an initial staging area 230 for receiving a vertically stacked deck or group of unshuffled cards. Preferably beneath the stack is a card extractor 232 that picks up a single card and moves it toward a grouping device 234. The picked up card moves through a card separator 236, which is provided in case more than one card is picked up, and then through a card accelerator 238. The grouping device 234 includes a plurality of compartments 240 defined, in part, by a plurality of generally horizontally disposed, parallel shelf members 242. In one embodiment there are two more compartments than player positions at the table at which the device is being used. In one preferred embodiment the grouping device 234 includes nine compartments (labeled 1-9), seven of which correspond to the player positions, one which corresponds to the dealer's position and the last for discards. The grouping device 234 is supported by a generally vertically movable elevator 244, the height of which is controlled by a stepper motor 246, linked by means of a belt drive 248 to the elevator 244. A microprocessor 250 randomly selects the location of the stepper motor 246 and instructs the stepper motor 246 to move the elevator 244 to that position. The microprocessor 250 is programmed to deliver a predetermined number of cards to each compartment 240. After the predetermined number of cards is delivered to a compartment 240, no additional cards will be delivered there.

Each time a group of unshuffled cards are handled by this embodiment of the present invention, the order in which the cards are delivered to the compartments 240 is different due to the use of a random number generator to determine which compartment 240 receives each card in the group. Making hands of cards in this particular fashion serves to randomize the cards to an extent sufficient to eliminate the need to shuffle the entire deck prior to forming hands.

A feature of the embodiment of the present invention depicted in FIG. 20 is a card pusher or rake 260A. The rake 260A may be either an arm with a head that pushes horizontally from the trailing edge of a card or group of cards, or a roller and belt arrangement 260B that propels a card or group of cards by providing frictional contact between one or more rollers and a lower surface of a card or the bottommost card. The purpose of the rake 260A is to move the cards toward an open end of the elevator 244. In this embodiment of the invention, the compartments 240 are staggered so that if the card rake 260A only pushes the dealt cards a portion of the way out the dealer can still lift out each hand of cards and deliver the hand to a player. The rake 260A can also be set to push a hand of cards completely out of a compartment whereby the cards fall onto a platform 262. The hand delivered to platform 262 may be then removed and handed to the player. A sensor may be provided adjacent to the platform 262 whereby an empty platform is sensed so that the rake 260A pushes or propels another hand of cards onto the platform 262.

In another embodiment the microprocessor 250 is programmed so that the card rake 260A moves the cards to a point accessible to the dealer and then, upon optional activation of a dealer control input, pushes the cards out of the compartment 240 onto the receiver 262.

In an embodiment depicted in FIG. 20, although the microprocessor 250 can be programmed to deliver a different number of cards to the dealer compartment than to the player compartments, it is contemplated that the microprocessor 250 will cause the apparatus to deliver the same number of cards to each compartment. The dealer, however, may discard cards until he or she arrives at the desired number of dealer cards for the particular game being played. For example, for the poker game known as the LET IT RIDE® game, the players and dealer initially receive a three-card hand. The dealer then discards or "burns" one of his cards and plays with the remaining two cards.

With continued reference to FIG. 20, nine card compartments or slots are depicted. The card extractor/separator combination delivers a selected number of player cards into each of the compartments labeled 1-7. Preferably, the same number of dealer's cards may be delivered into compartment 8. Alternatively, the microprocessor 250 can be programmed so that slot 8 will receive more than or fewer than the same number of cards as the players' compartments 1-7. In the embodiment depicted in FIG. 20, card-receiving compartment 9, which may be larger than the others, receives all extra cards from a deck. Preferably, the MPU instructs the card handler 202 to form only the maximum number of player hands plus a dealer hand. The number of cards delivered to each position may depend upon the game and the number of cards required.

Operation/Use

Figure 21A:
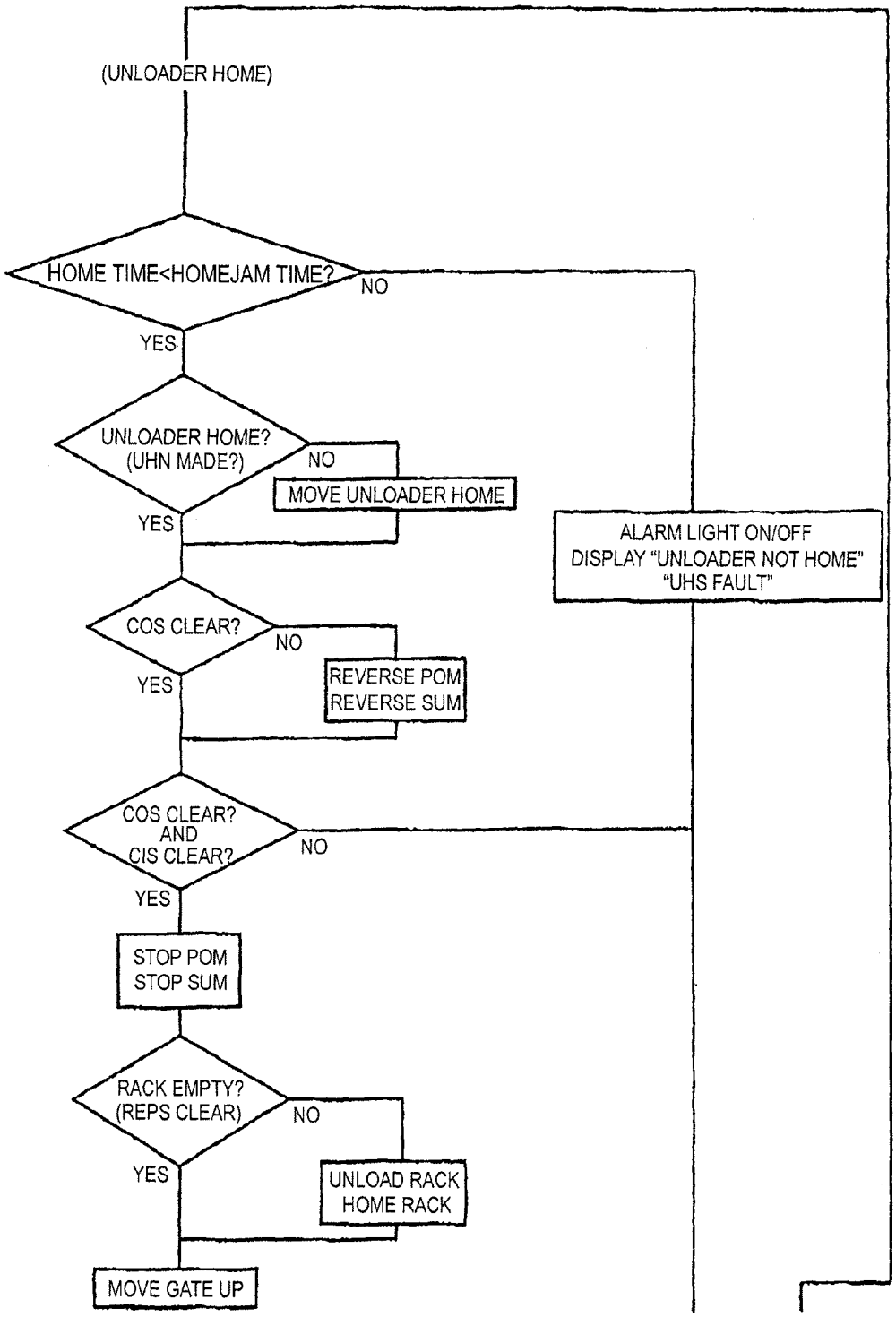
FIG. 21 is a flow diagram, comprising two parts, parts 21*a* and 21*b*, depicting a homing sequence.
Figure 21B:
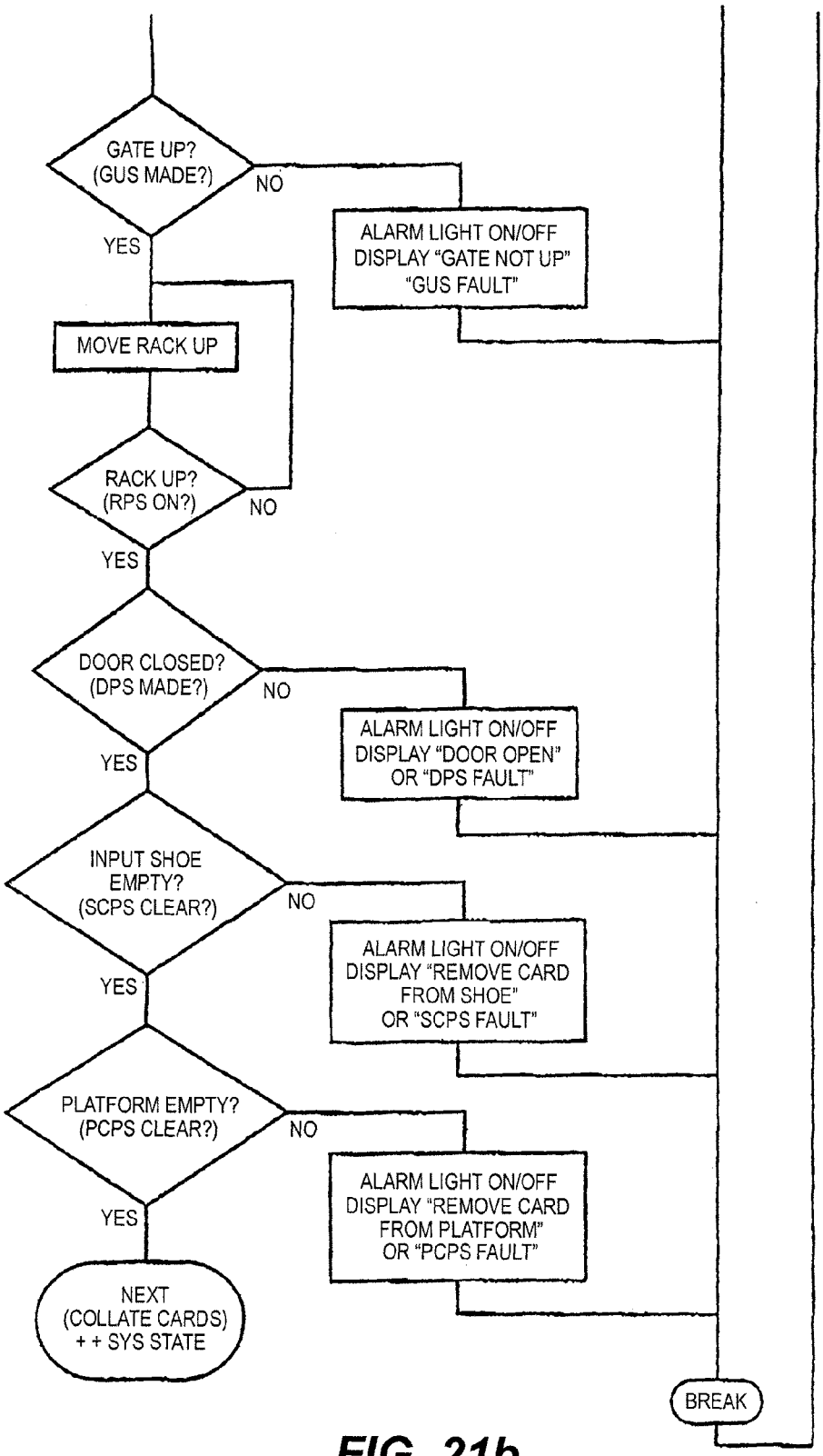
Figure 22A:
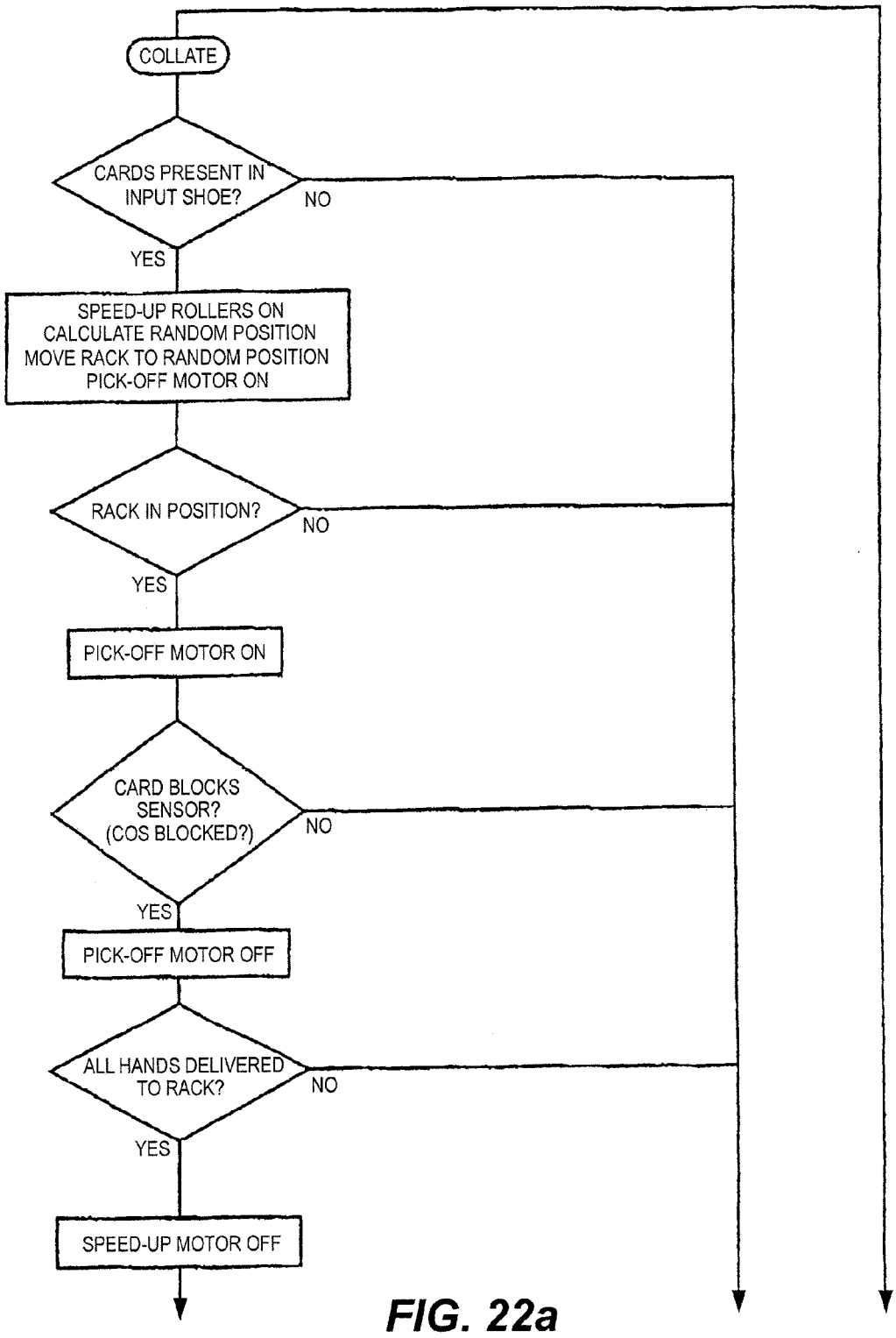
FIG. 22 is a flow diagram, comprising three parts, parts 22*a*, 22*b* and 22*c*, depicting a sequence of operation of the present invention.
Figure 22B:
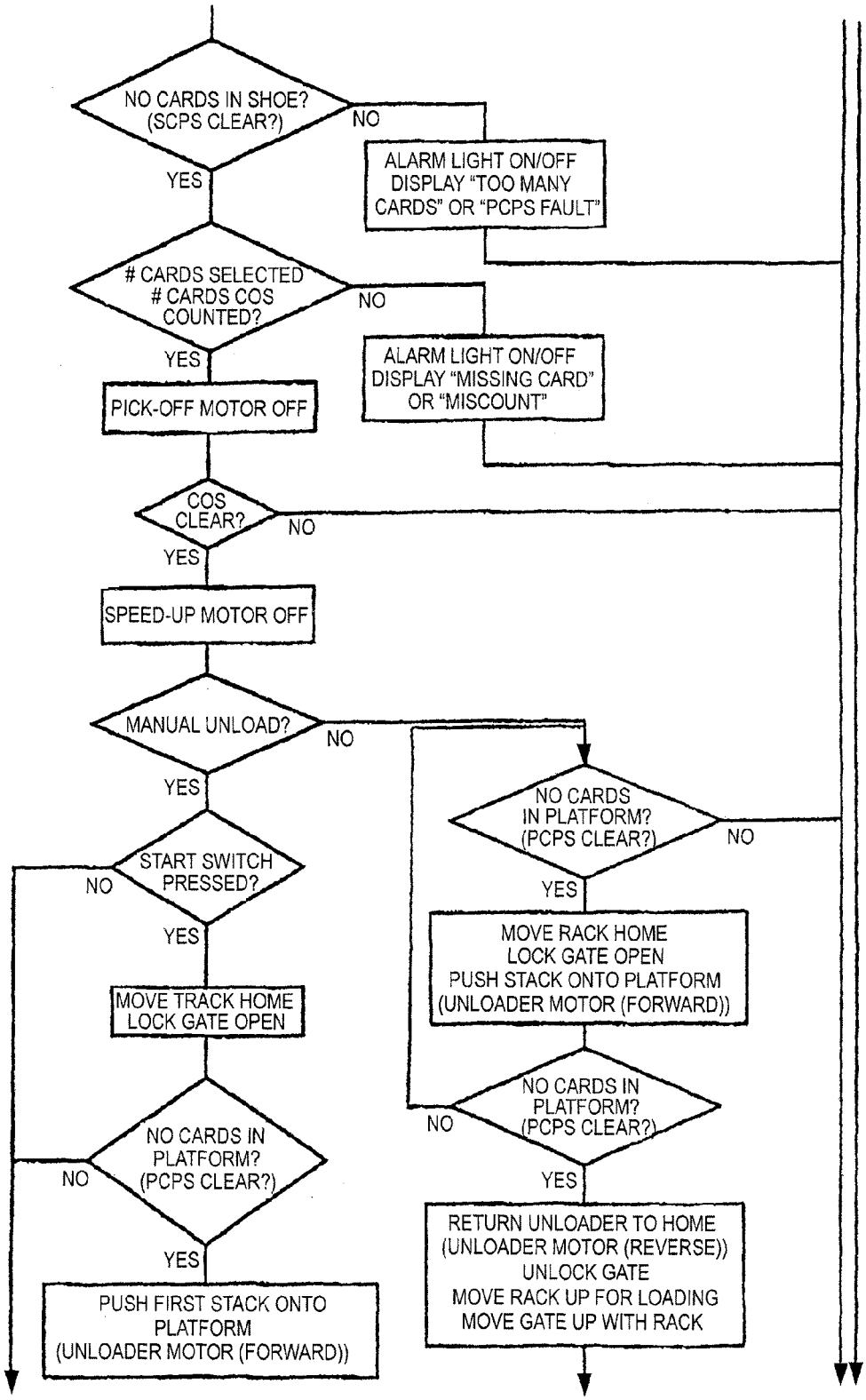
Figure 22C:
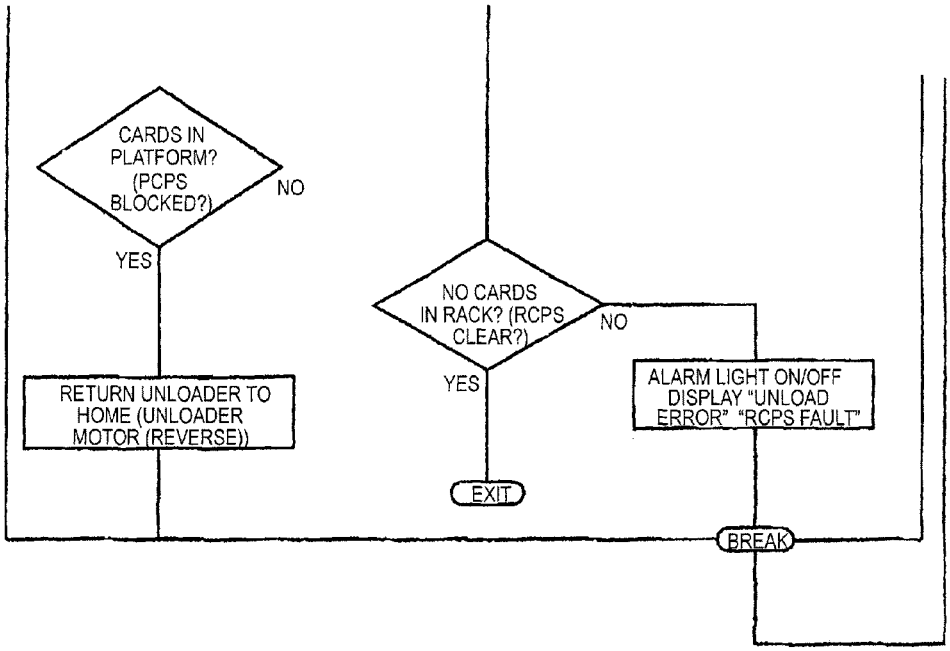

With reference to FIGS. 21 and 22, and Appendix C, which depict an operational program flow of the method and apparatus of the present invention, in use, cards are loaded into the well 60 by sliding or moving the block 68 generally rearwardly. The group of cards to be formed into hands or subgroups of partial hands is placed into the well 60 generally sideways, with the plane of the cards generally vertical, on one of the long side edges of the cards. The block 68 is released or replaced to urge the cards into an angular position generally corresponding to the angle of the angled card-contacting face of the block 68, and into contact with the pick-up roller 150.

According to the present invention, the group of cards to be formed into hands or partial hands is a single deck of standard playing cards. Depending upon the game, the group of cards can contain one or more wild cards, can be a standard deck with one or more cards removed, can comprise a special deck such as a Canasta or Spanish deck, for example, can include more than one deck, or can be a partial deck not previously recognized by those skilled in the art as a special deck. The present invention contemplates utilizing any group of cards suitable for playing a card game. For example, one may use the device of the present invention to form hands for a cards game that requires the use of a standard deck of cards with all cards having a face value of 2-5 removed.

The card-handling device of the present invention is well-suited for card games that deliver a fixed number of cards to each player. For example, the LET IT RIDE® stud poker game requires that the dealer deliver three cards to each player, and three cards to the dealer. For this application, the microprocessor is set so that only three-card groups of cards are formed. The device could easily be modified in software, hardware or software and hardware to deliver partial hands at different times during a single round of play.

When the power is turned on, the apparatus 20 homes (see FIG. 21 and Appendix B). The start input is actuated and the process cycle begins. As the cards are picked up, i.e., after the separation of a card from the remainder of the group of cards in the well 60 is started, a card is accelerated by the speed-up system 160 and spit or moved past the plates 180, 182 into a selected compartment 106, 120. Substantially simultaneously, movement of subsequent cards is underway. The rack assembly 28 position relative to the position of the transport mechanism 30 is monitored, selected and timed by the microprocessor whereby a selected number of cards is delivered randomly to selected compartments 106 until the selected number of compartments 106 each contain a randomized hand or partial hand of a selected number of cards. If the device is programmed to deliver complete hands, the remainder of the cards are delivered to the discard compartment 120, otherwise, the remaining cards are distributed to form a second subset of cards. Because the order in which the card are delivered is completely random, the device may or may not deliver all cards in the initial group of cards to all compartments before the first player hand or partial hand is pushed out of its compartment. Although it is preferred that a sufficient number of compartments be provided to build all sets of cards prior to delivery of the first card, it is possible but less preferred to deliver a first group of partial hands, then distribute additional cards into one or more of the same compartments to form additional partial hands.

When all the cards have been delivered to the compartments, upon demand or automatically, the pusher 190 unloads one randomly selected hand at a time from a compartment 106 into the second card-receiving platform 36. The pusher 190 may be triggered by the dealer or by the hand present sensor 212 associated with the second receiver 36. When the last hand is picked up and delivered to players and/or dealer, the larger discard compartment 120 automatically unloads. It should be appreciated that each cycle or operational sequence of the apparatus 20 goes through an entire group or deck of cards placed in the well 60 each time, even if only two players, i.e., two hands, are used.

The input system for use in the present technology may be any information or command input system, such as button pad, keyboard, touch screen and the like. The input system may be located on the shuffler, on the gaming table or elsewhere. The input information, as described above, may include dealer input that is typically in the form of a keypad and allows the dealer to a) dispense only the number of hands needed for the players at the table, b) allows the dealer to dispense multiple subgroups of cards for a round of play, and c) allows the dealer to select different numbers of cards in one or more hands or sub-hands. Touch screen systems are particularly effective as they can offer the dealer specific choices in sequence, and will not initiate the deal or advance to the next step until appropriate information has been input. Touch screens also avoid typographic errors that occur with keyboards. Key pads or series of buttons are particularly useful for similar reasons.

The technology that can be practiced herein can be further described as a card delivery device comprising playing cards that can be provided to a delivery tray and at least one playing card-transporting system that can deliver the playing cards to the delivery tray and a processor directing operation of the at least one playing card-transporting system wherein there is an input system for inputting directions to the processor, the input system enabling input of signals selected from the group consisting of:

a) specific number of hands to be dealt, a specific number of cards to be dealt to each hand, and/or a game identity;
b) specific number of community cards to be dealt after dealing of partial hands to at least all players;
c) specific number of subgroups of cards per round of play and a number of cards per subgroup;
d) specific number of dealer cards dealt;
e) specific format of selection of community cards to be dealt after dealing of partial hands to at least all players;
f) control over dealing residue cards or not dealing residue cards at completion of cards necessary for play of hands; and
g) control by dealer over delivery of additional cards after delivery of partial hands and activity by player(s) and/or dealer.

The system may be a shuffler or a card-delivery shoe.

Although a description of preferred embodiments has been presented, various changes including those mentioned above could be made without deviating from the spirit of the present invention. It is desired, therefore, that reference be made to the appended claims rather than to the foregoing description to indicate the scope of the invention.

APPENDIX A

| Item | Name | Description |
|---|---|---|
| Switches and Sensors (Inputs) | | |
| 212 | SCPS | Shoe Card-Present Sensor Omron * EE-SPY 302 |
| 116 | RCPS | Rack Card-Present Sensor Optek * 0P598A OP506A |
| | RHS | Rack Home Switch Microswitch * SS 14A |
| | RPS | Rack Position Sensor Omron * EE-SPZ401Y.01 |
| | UHS | Unloader Home Switch Microswitch * SS14A |
| | DPS | Door Present Switch Microswitch * SS14A |
| | PCPS | Platform Card-Present Sensor Omron * EE-SPY401 |
| 170 | CIS | Card-In Sensor Optek * OP506A |
| 176 | COS | Card-Out Sensor Optek * OP598A |
| | GUS | Gate Up Switch Microswitch * SS14A |

APPENDIX A-continued

| | | | |
|---|---|---|---|
| 44 | SS | Start Switch | EAO * 84-8512.5640 84-1101.0 84-7111.500 |
| Motors, Solenoid and Switches (Outputs) | | | |
| 154 | PUM | Pick-up Motor | Superior * M041-47103 |
| 167 | SUM | Speed-up Motor | Superior * M041-47103 |
| 80 | RM | Rack Motor | Oriental * C7009-9012K |
| 198 | UM | Unloader Motor | Superior * M041-47103 |
| | FM | Fan Motor | Mechatronics * F6025L24B |
| 143 | GS | Gate Solenoid | Shindengen * F10308H w/return spring |

APPENDIX A-continued

| | | |
|---|---|---|
| SSV | Scroll Switch - Vertical | EAO * 18-187.035 18-982.8 18-920.1 |
| SSH | Scroll Switch - Horizontal | EA0 * 18-187.035 18-982.8 18-920.1 |
| AL | Alarm Light | Dialight * 557-1505-203 |

Display Noritake * CU20025ECPB UIJ
Power Supply Shindengen * ZB241R8
Linear Guide THK * RSR12ZMUU + 145M
Comm. Port Digi * HR021 ND
Power Switch Digi * SW 323 ND
Power Entry Bergquist * LT 101 3P

APPENDIX B

Homing/Power-up i. Unloader Home UHS Made

Return unloader to home position. If it times out (jams), turn the alarm light on/off.

Display "UNLOADER NOT HOME" "UHS FAULT".

ii. Door Present DPS Made

Check door present switch (DPS). If it's not made, display "Door Open" "DPS

Fault" and turn the alarm light on/off.

iii. Card-Out Sensor (COS) Clear COS Made

If card-out sensor is blocked: A. Check if Rack Card-Present Sensor (RCPS) is blocked. If it is, drive card back (reverse both Pick-up Motor (PUM) and Speed-up Motor (SUM)) until COS is clear. Keep the card in the pinch. Align rack and load card into one of the shelves. Then go through the rack empty sequence (3 below). B.

If Rack Card-Present Sensor (RCPS) is clear, drive card back towards the input shoe.

Turn both the Speed-Up Motor (SUM) and the Pick-Off Motor on (reverse) until

Card-Out Sensor is clear plus time delay to drive the card out of the pinch.

iv. Gate Up GUS Made

Move rack up until the rack position sensor sees the top rack (RPS on). Gate up switch should be made (GUS). If not, display "GATE NOT UP" "GUS FAULT"

and turn the alarm light on/off.

v. Rack Empty and Home RCPS Made

Check Rack Card-Present Sensor (RCPS). If blocked, see emptying the racks. RHS Made Return rack home when done.

INTERLOCK: Do not move rack if card-out sensor is blocked (see 2 to clear) or when door is not present.

Emptying the racks: Go through the card unload sequence. Move rack down to home position. Energize solenoid. Move rack through the unload positions and unload all the cards.

vi. Input Shoe Empty SCPS Clear

If Shoe/Card-Present Sensor (SOPS) is blocked, display "remove card from shoe" or "SCPS fault" and turn the alarm light on/off.

vii. Platform Empty PCPS Clear

If Platform Card-Present Sensor (PCPS) is blocked, display "remove card from platform" or "PCPS Fault" and turn alarm light on/off.

viii. Card-in Sensor (CIS) Clear. CIS Made

If Card-In Sensor (CIS) is blocked, display "remove card from shoe" or "CIS fault"

and turn the alarm light on/off.

Start Position

| | |
|---|---|
| Unloader Home | UHS Made |
| Rack Home | RHS Made |
| Rack Empty | RCPS Made |
| Door In Place | DPS Made |
| Card-In Sensor Clear | CIS Made |
| Card-Out Sensor Clear | COS Made |

APPENDIX B-continued

| | |
|---|---|
| Gate Up | GUS Made |
| Platform Empty | PCPS Clear |
| Input Shoe Empty | SCPS Clear |
| Start Button Light On | |

APPENDIX C

Recovery Routine
Problem:
Card Jam - COS blocked too long.
Recovery:
1. Stop rack movement.
2. Reverse both pick-up and speed-up motors until "COS" is unblocked. Stop motors.
3. If "COS" is unblocked, move rack home and back to the rack where the cards should be inserted.
4. Try again with a lower insertion point (higher rack) and slower insertion speed. If card goes in, continue insertion. If card jams, repeat with the preset positions, auto adjust to the new position. If jams become too frequent, display "check cards", replace cards. If it doesn't, repeat 1 and 2.
5. If "COS" is unblocked, move rack up to the top position and display "Card Jam" and turn alarm light on/off.
6. If "COS" is not unblocked after 2 or 4, display "card jam" and turn. . .(do not move rack to up position).

Problem:
Unloader jams on the way out.
Recovery:
Move unloader back home. Reposition rack with a small offset up or down and try again, lower speed if necessary. If unloader jams, keep repeating at the preset location, set a new value based on the offset which works (auto adjust)

What is claimed:

1. A playing card delivery system comprising:

a playing card input area for receiving a group of playing cards;

a playing card output area;

a shuffling apparatus configured to produce sets of randomized playing cards from a group of cards received in the playing card input area;

a first mechanical playing card-moving device configured to move playing cards from the playing card input area to the shuffling apparatus;

a second mechanical playing card-moving device configured to move sets of playing cards from the shuffling apparatus to the playing card output area;

a processor programmed to execute instructions for control of the shuffling apparatus;

wherein the processor is programmed to direct the shuffling apparatus, in cooperation with the second mechanical playing card-moving device, to:

a) deliver a first randomized set of a first number of playing cards and comprising a partial hand to the playing card output area for delivery to a player position before completion of a shuffling cycle; and b) in the same shuffling cycle, deliver at least a second randomized set of a second number of playing cards to the playing card output area for delivery to the same player position to augment the partial hand, in at least a second dealing segment of the same game round; wherein the second number of playing cards of the second set is different from the first number of playing cards of the first set.

2. The playing card delivery system of claim 1, wherein the shuffling apparatus comprises a set of more than two compartments, each compartment sized and configured to receive and retain one or more playing cards.

3. The playing card delivery system of claim 2, wherein the compartments are positioned in one of a fan, a wheel, a carousel, and a vertically translatable rack.

4. The playing card delivery system of 3, wherein the compartments of the shuffling apparatus are of sufficient number to hold a first randomized set of playing cards and at least a second randomized set of playing cards for all player positions available for play of the game round, and a discard set of cards from the group of playing cards not used in the game round.

5. The playing card delivery system of claim 4, wherein the compartments of the shuffling apparatus are of sufficient number to hold a first randomized set of playing cards and at least a second randomized set of playing cards for all player positions available for play of the game round and for the house, and a discard set of cards from the group of playing cards not used in the game round.

6. The playing card delivery system of claim 4, wherein the compartments of the shuffling apparatus are of sufficient number to hold a first randomized set of playing cards and at least a second randomized set of playing cards for all player positions available for play of the game round, a set of one or more community cards, and a discard set of cards from the group of playing cards not used in the game round.

7. The playing card delivery system of claim 4, wherein the compartments of the shuffling apparatus are of sufficient number to hold a first randomized set of playing cards for all player positions available for play of the game round, a set of community playing cards, one or more sets each comprising a single card, and a discard set of cards from the group not used in the game round.

8. The playing card delivery system of claim 1, further comprising a dealer input system to provide information to the processor regarding a number of players in the game round, the first number of cards in the first set of playing cards to be provided to the card output area for delivery to the at least one player position, and the second number of playing cards in the at least a second set of playing cards to be provided to the card output area for delivery to the at least one player position.

9. The playing card delivery system of claim 8, wherein the dealer input system comprises at least one of buttons and a touch screen.

10. The playing card delivery system of claim 1, wherein the processor is programmed to cause the playing card delivery system to pause between performance of act a) and act b), and wherein act b) is initiated either responsive to execution of instructions by the processor or responsive to external input.

11. The playing card delivery system of claim 1, further comprising a playing card-present sensor in the playing card delivery area to send a signal to the processor when a set of playing cards is removed from the card output area to cause the processor to deliver an additional set of playing cards to the card output area.

12. A method of providing at least a first and second set of cards to each player, and, in addition to the first and second set of cards, optionally a set of community cards, a set of dealer cards or a set of bonus cards from a playing card delivery system comprising:

supporting a group of unshuffled cards in a card input of the delivery system; and moving the cards of the group using a first mechanical card-moving device to a shuffling apparatus;

producing a plurality of sets of randomized cards within the shuffling apparatus;

moving sets of randomized cards from the shuffling apparatus to a card output area of the playing card delivery system using the shuffling apparatus and a second mechanical card-moving device under control of a processor of the playing card delivery system executing instructions to, during a single shuffling cycle:

cause the second mechanical card-moving device to sequentially move, from the shuffling apparatus to the card output area, first sets of cards of a first number and each first set comprising a partial hand for delivery to a player position of a plurality of player positions; and cause the second the mechanical card-moving device to move, from the shuffling apparatus to the card output area, at least one second set of cards to augment the partial hands and selected from the group consisting of second sets of cards of a second number for delivery to at least some of the player positions, a community set of cards, a set of dealer cards and one or more sets of bonus cards;

wherein the second number of the second set of playing cards is different from the first number of playing cards of the first set.

13. The method of claim 12, further comprising moving to the card output area the at least one second set of a community set of cards, a set of dealer cards and a set of bonus cards after the movement of all of the first sets of cards for delivery to the plurality of player positions.

14. The method of claim 12, wherein the cards are randomized by random placement of playing cards into a plurality of compartments of the shuffling apparatus.

15. The method of claim 14, wherein the first number of cards and the second number of cards are different and first sets of the first number of cards are placed in at least some compartments and at least one second set of the second number of playing cards is placed in at least one other compartment.

16. The method of claim 12, wherein prior to actuating the card delivery system to output sets of cards at the card output area, inputting information to the processor relating to a number of active players at the plurality of player positions, a first number of cards for the first sets and a second number of cards for the at least one second set.

17. The method of claim 12, further comprising using a preprogrammed setting executable by the processor to select both the first number of cards for the first sets and the second number of cards for the at least one second set.

18. A playing card-delivery device having a card input, the device configured to produce sets of randomized playing cards to a card output under control of a processor executing instructions, the device comprising a dealer-accessible input system for inputting the instructions, the instructions selected from the group consisting of:

a) at least one of a specific number of hands participating in a current round of a game in combination with a specific number of playing cards to be transported to each hand during a shuffling cycle; and a game identity that specifies both a specific number of hands to be produced in combination with a specific number of cards to be produced for each hand during the same shuffling cycle;

b) a specific number of community cards in a set to be produced after production of sets for at least all players, the set of community cards and the sets for at least all players produced during the same shuffling cycle;

c) a specific number of sets of playing cards per player hand and a number of playing cards per set in the same shuffling cycle;

d) a specific number of dealer playing cards to be produced in a set of a number different from the number of player playing cards in the same shuffling cycle;

e) a specific format of selection of community playing cards to be produced after production of partial hands for at least all players, the community playing cards and the partial hands for at least all players produced during the same shuffling cycle;

f) production of residue playing cards or non-production of residue cards at completion of playing cards necessary for play of all hands in the current round, the production or non-production of residue cards and the play of all hands during the same shuffling cycle; and g) production of additional playing cards after production of sets of playing cards and at least one of activity by at least one player and activity by a dealer, the production of additional playing cards and sets of playing cards during the same shuffling cycle.

19. A processor-controlled playing card delivery device, comprising:

a playing card infeed area;

a playing card staging area comprising a playing card-shuffling apparatus for assembling sets of randomized play cards;

a first playing card-moving mechanism to move playing cards from the playing card infeed area to the playing card staging area;

a single playing card-receiving tray;

a second playing card-moving mechanism to move sets of playing cards from the playing card staging area to the single playing card-receiving tray, wherein the processor is programmed to cause the second playing card-moving mechanism to move, for each participating player position, at least two different sets of playing cards to the playing card-receiving tray during a single shuffling cycle, the at least two different sets of playing cards selected from the group consisting of: a) an initial partial player hand and a second number of cards to complete the initial partial player hand, b) an initial partial dealer hand and a third number of cards to complete the initial partial player hand, and c) at least one common playing card.

20. The playing card delivery device of claim 19, wherein the playing card-shuffling apparatus is a batch shuffler.

21. The playing card delivery device of claim 19, wherein the processor is programmed to cause at least two partial hands to be assembled by the shuffling apparatus for each player during a single round of shuffling.

22. The playing card delivery device of claim 19, wherein the second playing card-moving mechanism is configured to move multiple playing cards as a set to the playing card-receiving tray.

23. The playing card delivery device of claim 19, further comprising a sensor in the playing card-receiving tray to detect that a set of playing cards has been removed from the playing card-receiving tray and to send a signal to the processor to indicate such removal, in response to which signal the processor executes instructions to cause the second playing card-moving mechanism to deliver another set of playing cards when a previous set of playing cards has been manually removed.

24. The playing card delivery device of claim 19, further comprising a user input, for inputting to the processor at least one piece of information selected from the group consisting of: a selected game, a number of players in a game round, a number of playing cards per hand, a number of partial hands for a selected game, a number of playing cards per partial hand for a selected game, a number of playing cards for a dealer hand for a selected game, and a number of playing cards in a common hand for a common hand for a selected game.

25. The playing card delivery device of claim 19, wherein the processor is programmed to provide at least one group of playing cards to each player.

26. The card delivery device of claim 19, wherein the processor is programmed to provide at least one group of cards to each player position.

* * * * *